US007578568B2

(12) United States Patent
Usui

(10) Patent No.: US 7,578,568 B2
(45) Date of Patent: Aug. 25, 2009

(54) LIQUID EJECTION METHOD

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 431 days.

(21) Appl. No.: 11/315,331

(22) Filed: Dec. 23, 2005

(65) Prior Publication Data

US 2006/0176329 A1 Aug. 10, 2006

(30) Foreign Application Priority Data

Dec. 28, 2004 (JP) ..... 2004-381117
Nov. 8, 2005 (JP) ..... 2005-323953

(51) Int. Cl.
*B41J 29/38* (2006.01)

(52) U.S. Cl. ..... 347/11; 347/5; 347/40

(58) Field of Classification Search ..... 347/10–11, 347/23–25, 31–33, 40–42, 5
See application file for complete search history.

(56) References Cited

U.S. PATENT DOCUMENTS 6,312,077 B1 * 11/2001 Araki ..... 347/11
2004/0239721 A1 * 12/2004 Usuda ..... 347/40

FOREIGN PATENT DOCUMENTS

JP 2000-15843 A 1/2000
JP 2002-273912 A 9/2002

* cited by examiner

*Primary Examiner*—Lam S Nguyen
(74) *Attorney, Agent, or Firm*—Sughrue Mion, PLLC

(57) ABSTRACT

A liquid ejection method includes generating drive signals including ejection pulses, and applying the ejection pulses to an element that performs an operation for causing a liquid to be ejected. The element is provided corresponding to a nozzle. The nozzle causes the liquid to be ejected toward a targeted object. The generated drive signals are a first drive signal and a second drive signal. The first and second drive signals are generated simultaneously. The first drive signal includes a first ejection pulse for causing a liquid to be ejected to a targeted object, and the second drive signal includes a second ejection pulse for causing the liquid that has thickened in viscosity to be ejected outside the targeted object. When the nozzle is located above the targeted object, the first ejection pulse is applied to the element, and when the nozzle is located outside the targeted object, the second ejection pulse is applied to the element.

18 Claims, 18 Drawing Sheets

| pixel data | | flushing control signal | contents of operation |
|---|---|---|---|
| high-order | low-order | | |
| 0 | 0 | 1 | no dot (slight vibration) |
| 0 | 1 | 1 | small dot |
| 1 | 0 | 1 | medium dot |
| 1 | 1 | 1 | large dot |

| pixel data | | flushing control signal | contents of operation |
|---|---|---|---|
| high-order | low-order | | |
| 0 | 0 | 0 | flushing |
| 0 | 1 | 0 | flushing |
| 1 | 0 | 0 | flushing |
| 1 | 1 | 0 | flushing |

LIQUID EJECTION METHOD

CROSS-REFERENCE TO RELATED APPLICATIONS

The present application claims priority upon Japanese Patent Application No. 2004-381117 filed on Dec. 28, 2004 and Japanese Patent Application No. 2005-323953 filed on Nov. 8, 2005, which are herein incorporated by reference.

BACKGROUND

1. Technical Field

The present invention relates to liquid ejection methods.

2. Related Art

There are various types of liquid ejection apparatuses that cause liquid to be ejected from nozzles onto targeted objects, including, for example, printing apparatuses, color filter manufacturing apparatuses, and dyeing apparatuses. In such liquid ejection apparatuses, situations occur in which the liquid inside the nozzles thickens in viscosity due to the solvent component of the liquid evaporating, for example. Liquid that has thickened in viscosity (which is also referred to hereinafter as "thickened liquid") is not preferable since it may cause the directions in which the liquid flies to vary or give rise to clogging in the nozzles. In view of this, liquid ejection apparatuses that carry out operations allowing thickened liquid to be ejected from nozzles that have moved away from a targeted object have been proposed. For example, as a type of printing apparatus that ejects ink toward a medium, one that ejects thickened ink by ejecting ink from nozzles that have moved away from the medium has been proposed. (See, for example, JP-A-2000-15843.) Further, operations for allowing thickened liquid to be ejected are performed employing dedicated drive signals exclusively used for that purpose. (See, for example, JP-A-2002-273912.)

As described above, in order to perform the operations for allowing thickened liquid to be ejected, it is necessary to make a drive signal generation section generate the dedicated drive signals. It is thus necessary to change the drive signals to be generated by the drive signal generation section for cases where the nozzles are located above the targeted object and for cases where the nozzles are located outside the targeted object. To enable this change, it is necessary to perform special control such as interruption processing, which makes the control complicated.

SUMMARY

The present invention has been achieved in view of the foregoing circumstances, and it is an object thereof to allow thickened liquid to be ejected with a simple control.

A primary aspect of the invention for achieving the above objects is a liquid ejection method as follows.

That is, a liquid ejection method includes:

(a) simultaneously generating a first drive signal including a first ejection pulse for causing a liquid to be ejected to a targeted object, and a second drive signal including a second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse to the element.

Features and objects of the present invention other than the above will become clear by reading the description of the present specification with reference to the appended drawings.

DESCRIPTION OF EXEMPLARY EMBODIMENTS

Figure 1:
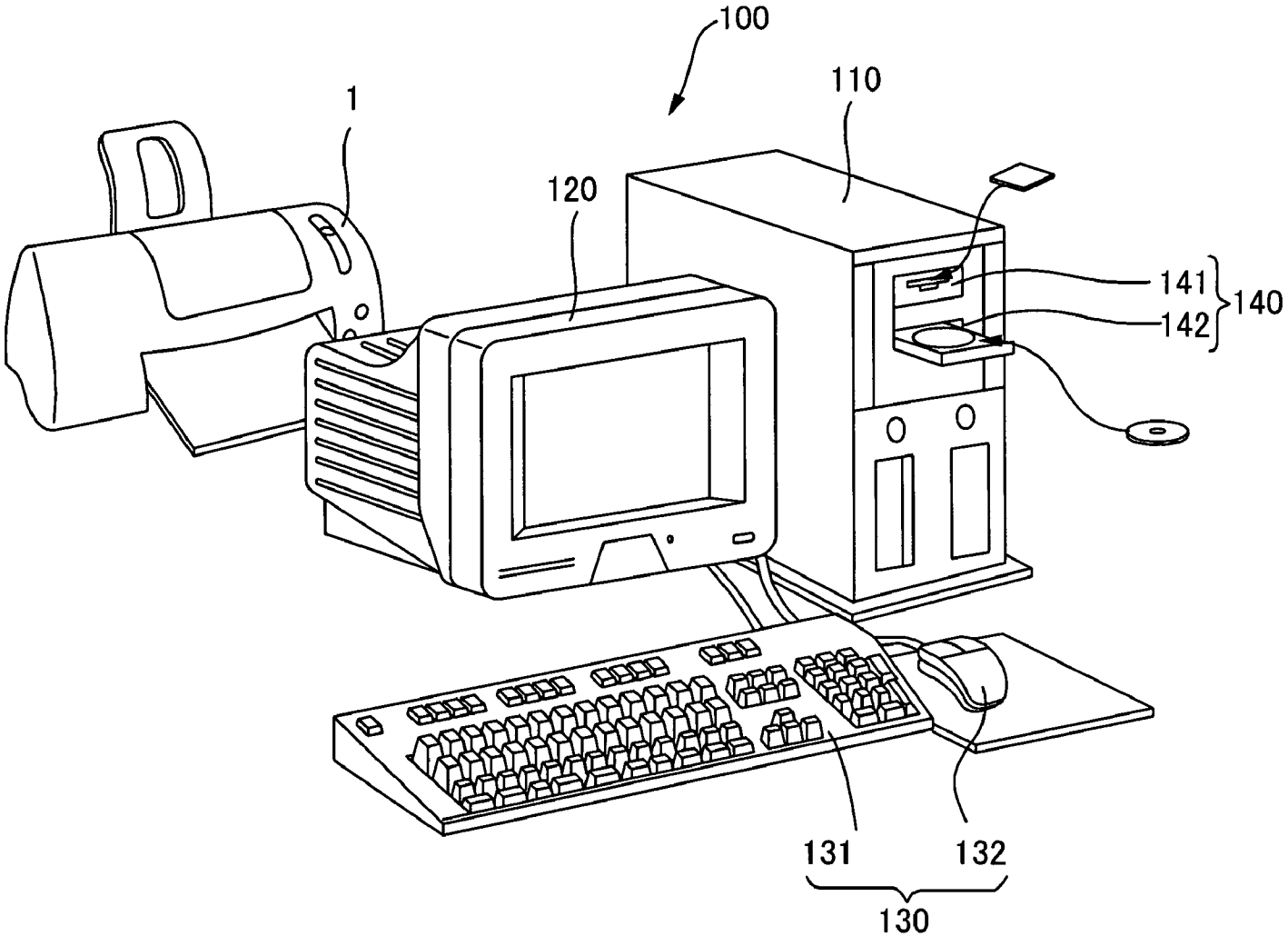
FIG. 1 is a diagram that describes a configuration of a printing system.

At least the following matters will be made clear by the description of the present specification and the accompanying drawings.

First, it is made clear that the following liquid ejection method can be achieved.

A liquid ejection method includes:

(a) simultaneously generating a first drive signal including a first ejection pulse for causing a liquid to be ejected to a targeted object, and a second drive signal including a second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse to the element.

With this liquid ejection method, a first drive signal including a first ejection pulse and a second drive signal including a second ejection pulse are generated simultaneously, and the second ejection pulse is applied to an element when the nozzle is located outside the targeted object. Therefore, the process for changing the drive signals to be generated becomes unnecessary, and thus, thickened liquid can be ejected with a simple control.

In the foregoing liquid ejection method, it is preferable that a plurality of the nozzles are provided at different positions in a predetermined direction, and the nozzles are movable in the predetermined direction; when at least one of the nozzles is located above the targeted object, the first ejection pulse is applied to the element corresponding to that nozzle; and when at least one of the nozzles is located outside the targeted object, the second ejection pulse is applied to the element corresponding to that nozzle.

With this liquid ejection method, as regards the plurality of nozzles, the first ejection pulse is applied to the element corresponding to a nozzle located above the targeted object, and the second ejection pulse is applied to the element corresponding to a nozzle located outside the targeted object. Therefore, it is possible to allow ejection of the liquid to the targeted object and ejection of the thickened liquid outside the targeted object to be performed simultaneously.

In the foregoing liquid ejection method, it is preferable that a plurality of the nozzles are provided at different positions in an other predetermined direction intersecting with the predetermined direction, to form a nozzle row; when the nozzle row is located above the targeted object, the first ejection pulse is applied to the elements respectively corresponding to the nozzles in that nozzle row; and when the nozzle row is located outside the targeted object, the second ejection pulse is applied to the elements respectively corresponding to the nozzles in that nozzle row.

With this liquid ejection method, an improvement in the efficiency in processing can be achieved because application of the first ejection pulse and application of the second ejection pulse are selected for each nozzle row.

In the foregoing liquid ejection method, it is preferable that the second ejection pulse is generated in a period in which the first ejection pulse is being generated.

With this liquid ejection method, the period in which the first ejection pulse is generated and the period in which the second ejection pulse is generated overlap. Therefore, it is possible to efficiently generate the first ejection pulse and the second ejection pulse, even in a limited period (repeating cycle).

In the foregoing liquid ejection method, it is preferable that the second drive signal further includes an other first ejection pulse for causing the liquid to be ejected to the targeted object, and this second drive signal is generated simultaneously with the first drive signal; and when the nozzle is located above the targeted object, at least one of the first ejection pulse and the other first ejection pulse is applied to the element.

With this liquid ejection method, ejection of the liquid to the targeted object can be performed using the first ejection pulse included in the first drive signal and the other first ejection pulse included in the second drive signal. Accordingly, it is possible to increase the degree of freedom of the liquid to be ejected to the targeted object, even in a limited period.

Further, it is also made clear that the following liquid ejection method can be achieved.

A liquid ejection method includes:

(a) simultaneously generating a first drive signal including a first ejection pulse for causing a liquid to be ejected to a targeted object and a second ejection pulse for causing the liquid that has thickened in viscosity to be ejected outside the targeted object, and a second drive signal including an other second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse and the other second ejection pulse to the element.

With this liquid ejection method, a first drive signal including a first ejection pulse and a second ejection pulse, and a second drive signal including another second ejection pulse are generated simultaneously, and the second ejection pulse and the other second ejection pulse are applied to an element when the nozzle is located outside the targeted object. Therefore, the process for changing the drive signals to be generated becomes unnecessary, and thus, thickened liquid can be ejected with a simple control. Further, the second ejection pulse and the other second ejection pulse are used when causing the liquid thickened in viscosity to be ejected. Therefore, it is possible to shorten the liquid ejection interval, even in a limited period. As a result, the thickened liquid can be discharged reliably.

In the foregoing liquid ejection method, it is preferable that a plurality of the nozzles are provided at different positions in a predetermined direction, and the nozzles are movable in the predetermined direction; when at least one of the nozzles is located above the targeted object, the first ejection pulse is applied to the element corresponding to that nozzle; and when at least one of the nozzles is located outside the targeted object, the second ejection pulse and the other second ejection pulse are applied to the element corresponding to that nozzle.

With this liquid ejection method, as regards the plurality of nozzles, the first ejection pulse is applied to the element corresponding to a nozzle located above the targeted object, and the second ejection pulse and the other second ejection pulse are applied to the element corresponding to a nozzle located outside the targeted object. Therefore, it is possible to allow ejection of the liquid to the targeted object and ejection of the thickened liquid outside the targeted object to be performed simultaneously.

In the foregoing liquid ejection method, it is preferable that a plurality of the nozzles are provided at different positions in an other predetermined direction intersecting with the predetermined direction, to form a nozzle row; when the nozzle row is located above the targeted object, the first ejection pulse is applied to the elements respectively corresponding to the nozzles in that nozzle row; and when the nozzle row is located outside the targeted object, the second ejection pulse and the other second ejection pulse are applied to the elements respectively corresponding to the nozzles in that nozzle row.

With this liquid ejection method, an improvement in the efficiency in processing can be achieved because application of the first ejection pulse and application of the second ejection pulse and the other second ejection pulse are selected for each nozzle row.

In the foregoing liquid ejection method, it is preferable that the other second ejection pulse is generated in a period in which the first ejection pulse is being generated.

With this liquid ejection method, the period in which the first ejection pulse is generated and the period in which the other second ejection pulse is generated overlap. Therefore, it is possible to efficiently generate the first ejection pulse and the other second ejection pulse, even in a limited period.

In the foregoing liquid ejection method, it is preferable that the second drive signal further includes an other first ejection pulse for causing the liquid to be ejected to the targeted object, and this second drive signal is generated simultaneously with the first drive signal; and when the nozzle is located above the targeted object, at least one of the first ejection pulse and the other first ejection pulse is applied to the element.

With this liquid ejection method, ejection of the liquid to the targeted object can be performed using the first ejection pulse included in the first drive signal and the other first ejection pulse included in the second drive signal. Accordingly, it is possible to increase the degree of freedom of the liquid to be ejected to the targeted object, even in a limited period.

In the foregoing liquid ejection method, it is preferable that the second ejection pulse is generated in a period in which the other first ejection pulse is being generated.

With this liquid ejection method, the period in which the other first ejection pulse is generated and the period in which the second ejection pulse is generated overlap. Therefore, it is possible to efficiently generate the other first ejection pulse and the second ejection pulse, even in a limited period.

Further, it is also made clear that the following liquid ejection method can be achieved.

A liquid ejection method includes:

(a) simultaneously generating a first drive signal including a first ejection pulse for causing a liquid to be ejected to a targeted object and one portion of a second ejection pulse for causing the liquid that has thickened in viscosity to be ejected outside the targeted object, and a second drive signal including an other portion of the second ejection pulse;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the one portion and the other portion of the second ejection pulse to the element.

With this liquid ejection method, a first drive signal including a first ejection pulse and a portion of a second ejection pulse, and a second drive signal including another portion of the second ejection pulse are generated simultaneously, and the one portion and the other portion of the second ejection pulse (i.e., the entire second ejection pulse) are applied to an element when the nozzle is located outside the targeted object. Therefore, the process for changing the drive signals to be generated becomes unnecessary, and thus, thickened liquid can be ejected with a simple control. Further, it is possible to efficiently include the drive pulses, even in a limited period.

In the foregoing liquid ejection method, it is preferable that a plurality of the nozzles are provided at different positions in a predetermined direction, and the nozzles are movable in the predetermined direction; when at least one of the nozzles is located above the targeted object, the first ejection pulse is applied to the element corresponding to that nozzle; and when at least one of the nozzles is located outside the targeted object, the one portion and the other portion of the second ejection pulse are applied to the element corresponding to that nozzle.

With this liquid ejection method, as regards the plurality of nozzles, the first ejection pulse is applied to the element corresponding to a nozzle located above the targeted object, and the one portion and the other portion of the second ejection pulse are applied to the element corresponding to a nozzle located outside the targeted object. Therefore, it is possible to allow ejection of the liquid to the targeted object and ejection of the thickened liquid outside the targeted object to be performed simultaneously.

In the foregoing liquid ejection method, it is preferable that a plurality of the nozzles are provided at different positions in an other predetermined direction intersecting with the predetermined direction, to form a nozzle row; when the nozzle row is located above the targeted object, the first ejection pulse is applied to the elements respectively corresponding to the nozzles in that nozzle row; and when the nozzle is located outside the targeted object, the one portion and the other portion of the second ejection pulse are applied to the elements respectively corresponding to the nozzles in that nozzle row.

With this liquid ejection method, an improvement in the efficiency in processing can be achieved because application of the first ejection pulse and application of the one portion and the other portion of the second ejection pulse are selected for each nozzle row.

In the foregoing liquid ejection method, it is preferable that the other portion of the second ejection pulse is generated in a period in which the first ejection pulse is being generated.

With this liquid ejection method, the period in which the first ejection pulse is generated and the period in which the other portion of the second ejection pulse is generated overlap. Therefore, it is possible to efficiently generate the first ejection pulse and the other portion of the second ejection pulse, even in a limited period.

In the foregoing liquid ejection method, it is preferable that the second drive signal further includes an other first ejection pulse for causing the liquid to be ejected to the targeted object, and this second drive signal is generated simultaneously with the first drive signal; when the nozzle is located above the targeted object, at least one of the first ejection pulse and the other first ejection pulse is applied to the element; and when the nozzle is located outside the targeted object, the one portion and the other portion of the second ejection pulse are applied to the element.

With this liquid ejection method, ejection of the liquid to the targeted object can be performed using the first ejection pulse included in the first drive signal and the other first ejection pulse included in the second drive signal. Accordingly, it is possible to increase the degree of freedom of the liquid to be ejected to the targeted object, even in a limited period.

In the foregoing liquid ejection method, it is preferable that the one portion of the second ejection pulse is generated in a period in which the other first ejection pulse is being generated.

With this liquid ejection method, the period in which the other first ejection pulse is generated and the period in which the one portion of the second ejection pulse is generated overlap. Therefore, it is possible to efficiently generate the other first ejection pulse and the one portion of the second ejection pulse, even in a limited period.

In the foregoing liquid ejection method, it is preferable that the method further includes determining whether or not at least one of the nozzles is located above the targeted object based on a detection result from a sensor that moves along with the nozzles and that detects whether or not the targeted object is present.

With this liquid ejection method, whether or not the targeted object is present is detected based on a detection result from a sensor that moves with the nozzle. Accordingly, it is possible to precisely get hold of the positional relationship between the targeted object and the nozzle.

In the foregoing liquid ejection method, it is preferable that when the nozzle is located above the targeted object, the first ejection pulse is applied to the element by controlling, based on switch control information, an operation of a first switch that controls the application of the first drive signal to the element; and when the nozzle is located outside the targeted object, the second ejection pulse is applied to the element by controlling, based on the switch control information, an operation of a second switch that controls the application of the second drive signal to the element.

With this liquid ejection method, it is possible to apply the first drive signal and/or the second drive signal to the element according to the switch control information. Thus, control is easy.

In the foregoing liquid ejection method, it is preferable that the liquid is a liquid ink for printing; and the targeted object is a medium on which an image is to be printed.

With this liquid ejection method, as for liquid ink for printing that is easily affected by thickening in viscosity, thickened ink can be ejected with a simple control.

Further, it is also made clear that the following liquid ejection apparatus can be achieved.

A liquid ejection apparatus includes:

(A) a nozzle that makes a liquid be ejected toward a targeted object;

(B) an element that is provided corresponding to the nozzle and that performs an operation for causing the liquid to be ejected;

(C) a drive signal generation section that simultaneously generates a first drive signal including a first ejection pulse for causing the liquid to be ejected to the targeted object, and a second drive signal including a second ejection pulse for causing the liquid that has thickened in viscosity to be ejected outside the targeted object; and (D) a controller that makes the first ejection pulse be applied to the element when the nozzle is located above the targeted object, and makes the second ejection pulse be applied to the element when the nozzle is located outside the targeted object.

With this liquid ejection apparatus, the process for changing the drive signals to be generated becomes unnecessary, and thus, thickened liquid can be ejected with a simple control.

Further, it is also made clear that the following liquid ejection apparatus can be achieved.

A liquid ejection apparatus includes:

(A) a nozzle that makes a liquid be ejected toward a targeted object;

(B) an element that is provided corresponding to the nozzle and that performs an operation for causing the liquid to be ejected;

(C) a drive signal generation section that simultaneously generates a first drive signal including a first ejection pulse for causing the liquid to be ejected to the targeted object and a second ejection pulse for causing the liquid that has thickened in viscosity to be ejected outside the targeted object, and a second drive signal including an other second ejection pulse for causing the liquid that has thickened in viscosity to be ejected outside the targeted object; and (D) a controller that makes the first ejection pulse be applied to the element when the nozzle is located above the targeted object, and makes the second ejection pulse and the other second ejection pulse be applied to the element when the nozzle is located outside the targeted object.

With this liquid ejection apparatus, the process for changing the drive signals to be generated becomes unnecessary, and thus, thickened liquid can be ejected with a simple control. Further, the second ejection pulse and the other second ejection pulse are used when causing the liquid thickened in viscosity to be ejected. Therefore, it is possible to shorten the liquid ejection interval, even in a limited period. As a result, the thickened liquid can be discharged reliably.

Further, it is also made clear that the following liquid ejection apparatus can be achieved.

A liquid ejection apparatus includes:

(A) a nozzle that makes a liquid be ejected toward a targeted object;

(B) an element that is provided corresponding to the nozzle and that performs an operation for causing the liquid to be ejected;

(C) a drive signal generation section that simultaneously generates a first drive signal including a first ejection pulse for causing the liquid to be ejected to the targeted object and one portion of a second ejection pulse for causing the liquid that has thickened in viscosity to be ejected outside the targeted object, and a second drive signal including an other portion of the second ejection pulse; and (D) a controller that makes the first ejection pulse be applied to the element when the nozzle is located above the targeted object, and makes the one portion and the other portion of the second ejection pulse be applied to the element when the nozzle is located outside the targeted object.

With this liquid ejection apparatus, the process for changing the drive signals to be generated becomes unnecessary, and thus, thickened liquid can be ejected with a simple control. Further, it is possible to efficiently include the drive pulses, even in a limited period.

Further, it is also made clear that the following storage medium for storing a program can be achieved.

Provided is a storage medium storing a program, wherein the program includes:

(a) a code for causing a liquid ejection apparatus to simultaneously generate a first drive signal including a first ejection pulse for causing a liquid to be ejected to a targeted object, and a second drive signal including a second ejection pulse for causing the liquid that has thickened in viscosity to be ejected outside the targeted object;

(b) a code for causing, when a nozzle that is caused to eject the liquid toward the targeted object is located above the targeted object, the liquid ejection apparatus to apply the first ejection pulse to an element that is provided corresponding to the nozzle and that performs an operation for causing the liquid to be ejected; and (c) a code for causing, when the nozzle is located outside the targeted object, the liquid ejection apparatus to apply the second ejection pulse to the element.

Further, it is also made clear that the following storage medium for storing a program can be achieved.

Provided is a storage medium storing a program, wherein the program includes:

(a) a code for causing a liquid ejection apparatus to simultaneously generate a first drive signal including a first ejection pulse for causing a liquid to be ejected to a targeted object and a second ejection pulse for causing the liquid that has thickened in viscosity to be ejected outside the targeted object, and a second drive signal including an other second ejection pulse for causing the liquid that has thickened in viscosity to be ejected outside the targeted object;

(b) a code for causing, when a nozzle that is caused to eject the liquid toward the targeted object is located above the targeted object, the liquid ejection apparatus to apply the first ejection pulse to an element that is provided corresponding to the nozzle and that performs an operation for causing the liquid to be ejected; and (c) a code for causing, when the nozzle is located outside the targeted object, the liquid ejection apparatus to apply the second ejection pulse and the other second ejection pulse to the element.

Further, it is also made clear that the following storage medium for storing a program can be achieved.

Provided is a storage medium storing a program, wherein the program includes:

(a) a code for causing a liquid ejection apparatus to simultaneously generate a first drive signal including a first ejection pulse for causing a liquid to be ejected to a targeted object and one portion of a second ejection pulse for causing the liquid that has thickened in viscosity to be ejected outside the targeted object, and a second drive signal including an other portion of the second ejection pulse;

(b) a code for causing, when a nozzle that is caused to eject the liquid toward the targeted object is located above the targeted object, the liquid ejection apparatus to apply the first ejection pulse to an element that is provided corresponding to the nozzle and that performs an operation for causing the liquid to be ejected; and (c) a code for causing, when the nozzle is located outside the targeted object, the liquid ejection apparatus to apply the one portion and the other portion of the second ejection pulse to the element.

First Embodiment

<Regarding Liquid Ejection Apparatus>

A variety of apparatuses fall within the scope of liquid ejection apparatuses, including printing apparatuses, color filter manufacturing apparatuses, display manufacturing apparatuses, semiconductor manufacturing apparatuses, and DNA chip manufacturing apparatuses, and to include all of these in the following description would be difficult. Accordingly, this specification is described with respect to a printer that serves as a printing apparatus and a printing system that includes this printer as examples. It should be noted that the printing system is a system that has at least a printing apparatus and a print control apparatus that controls the operation of this printing apparatus, and corresponds to an implementation of a liquid ejection system that has a liquid ejection apparatus and an ejection control apparatus.

Configuration of Printing System 100

<Regarding Overall Configuration>

First, a printing apparatus will be described along with a printing system 100. Here, FIG. 1 is a diagram that illustrates the configuration of the printing system 100. This illustrative printing system 100 shown here includes a printer 1 as a printing apparatus and a computer 110 as a print control apparatus. Specifically, the printing system 100 includes the printer 1, the computer 110, a display device 120, an input device 130, and a record/play device 140.

The printer 1 prints images on a medium such as paper, cloth, and film. It should be noted that the medium corresponds to the "targeted object" targeted for liquid ejection. Further, in the following description, paper S (see FIG. 3A), which is a representative medium, serves as an illustrative example. The computer 110 is communicably connected to the printer 1. In order to make the printer 1 print an image, the computer 110 outputs print data corresponding to that image to the printer 1. Computer programs such as an application program and a printer driver are installed on the computer 110. The display device 120 has a display. The display device 120 is for example a device for displaying a user interface of the computer programs. The input device 130 is for example a keyboard 131 and a mouse 132. The record/play device 140 is for example a flexible disk drive device 141 and a CD-ROM drive device 142.

Computer 110

<Regarding Configuration of the Computer 110>

Figure 2:
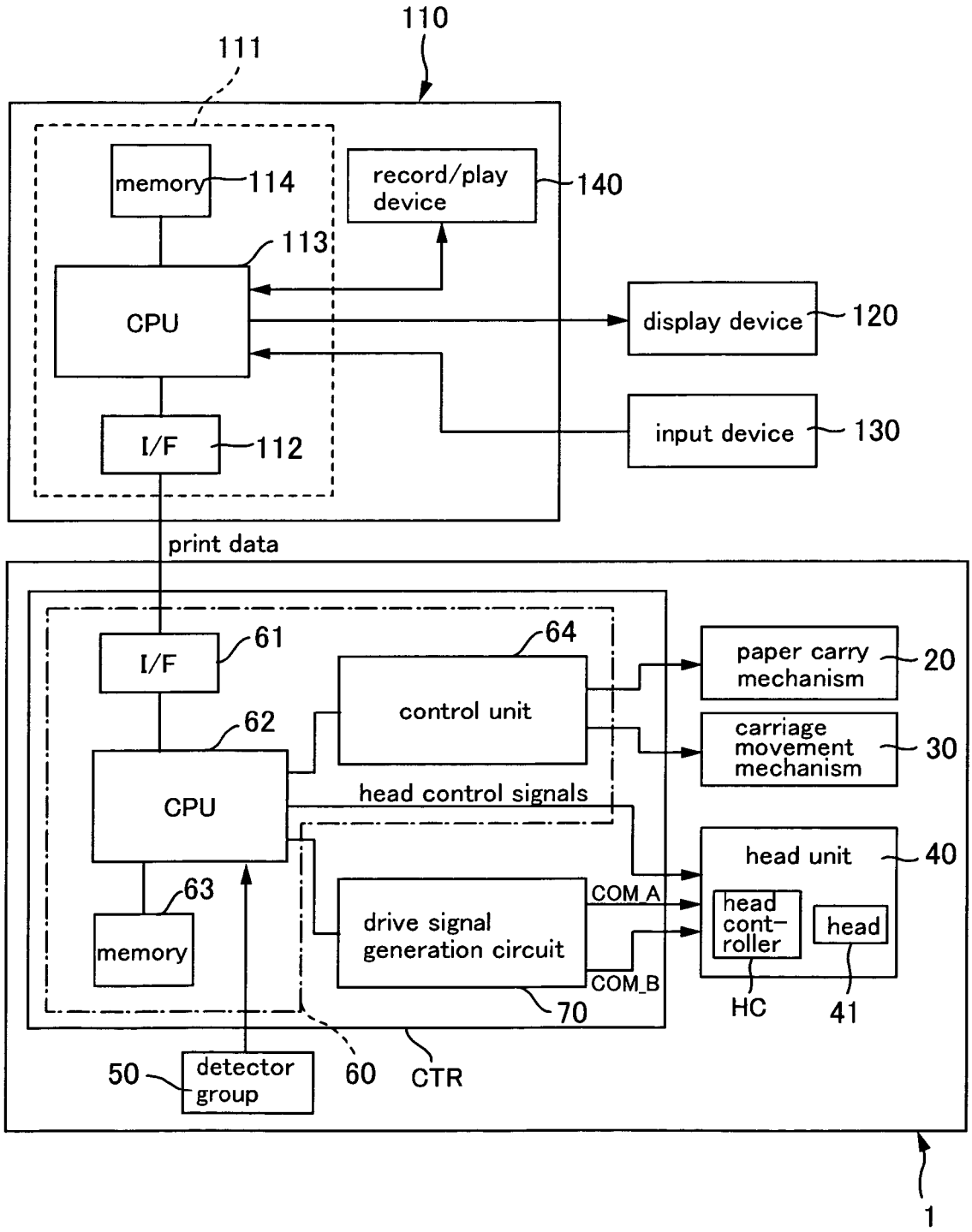
FIG. 2 is a block diagram for describing a configuration of a computer and a printer.

FIG. 2 is a block diagram that describes the configuration of the computer 110 and the printer 1. First, the configuration of the computer 110 is described in brief. The computer 110 has the record/play device 140 described above and a host-side controller 111. The record/play device 140 is communicably connected to the host-side controller 111, and for example is attached to the housing of the computer 110. The host-side controller 111 performs various controls in the computer 110, and is also communicably connected to the display device 120 and the input device 130 mentioned above. The host-side controller 111 has an interface section 112, a CPU 113, and a memory 114. The interface section 112 sends and receives data between the computer and the printer 1. The CPU 113 is a computation processing device for performing the overall control of the computer 110. The memory 114 is for reserving a working area and an area for storing computer programs used by the CPU 113, and is constituted by a RAM, EEPROM, ROM, or magnetic disk device, for example. Examples of computer programs that are stored on the memory 114 include the application program and printer driver mentioned above. The CPU 113 performs various controls in accordance with the computer programs stored on the memory 114.

Figure 8:
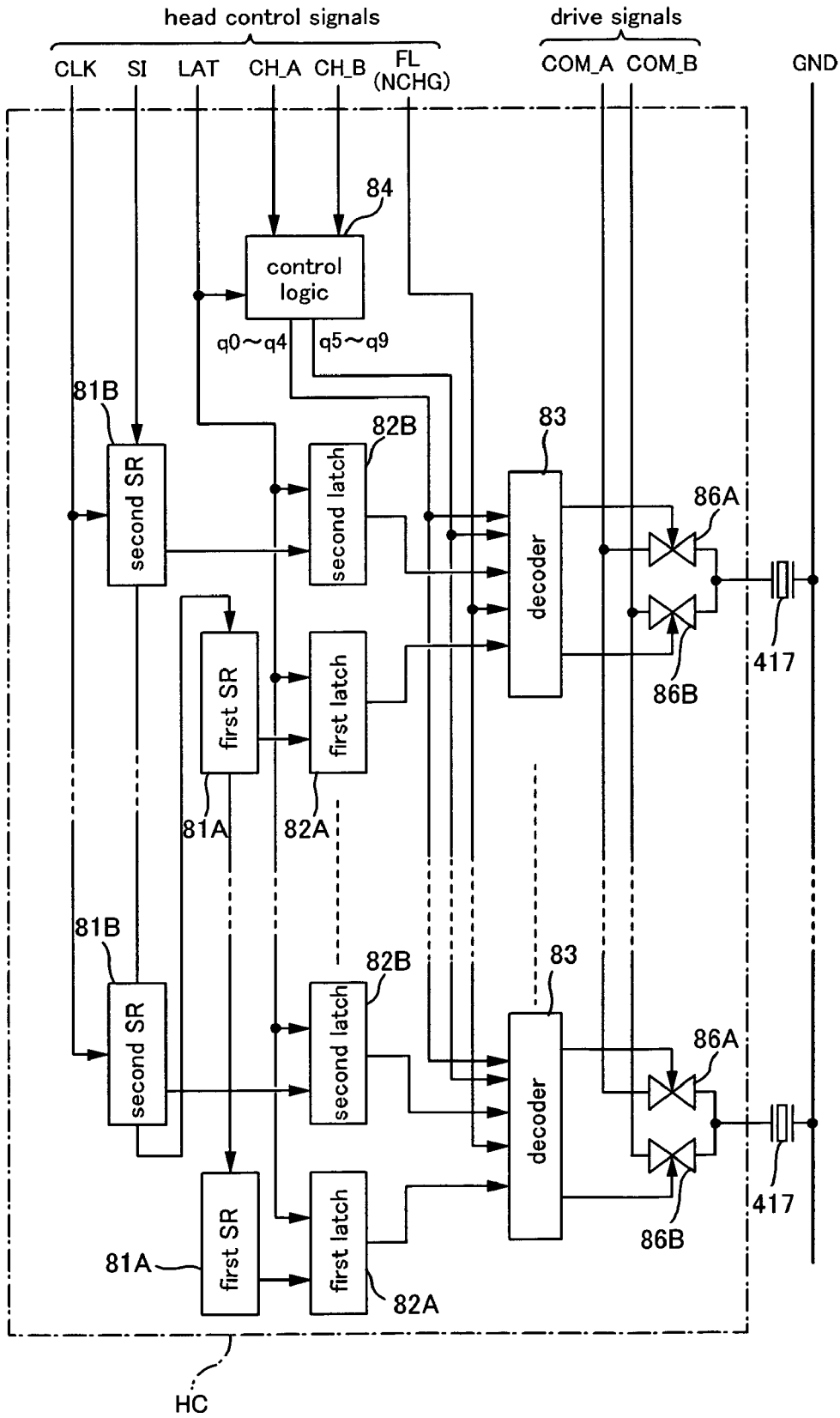
FIG. 8 is a block diagram for describing a configuration of a head controller.

The print data are data in a form that can be interpreted by the printer 1, and include various command data and pixel data SI (see FIG. 8). Command data are data for ordering the printer 1 to execute a specific operation. Among the command data are command data that order the supply of paper, command data that indicate a carry amount, and command data that order the discharge of paper. The pixel data SI is data relating to each pixel in the image to be printed. Here, a pixel is a matrix-like square virtually defined on the paper, and indicates a region in which a dot is to be formed. The pixel data SI in the print data is data relating to a dot to be formed on the paper (for example, the gradation value). In this embodiment, the pixel data SI are each made of two bits of data. That is, the pixel data SI are a data value "00" corresponding to no dot (non-ejection of ink), a data value "01" corresponding to the formation of a small dot, a data value "10" corresponding to the formation of a medium dot, or a data value "11" corresponding to the formation of a large dot. The printer 1 can thus form images at four gradation levels per pixel.

Printer 1

<Regarding Configuration of the Printer 1>

Figure 3A:
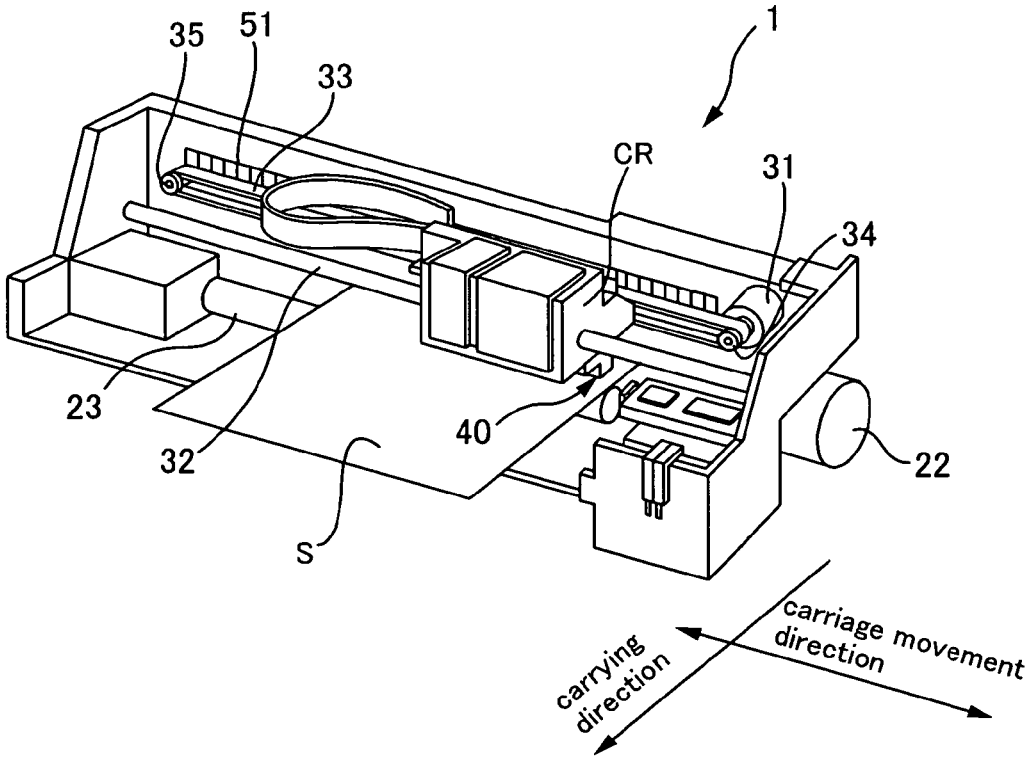
FIG. 3A is a diagram showing the configuration of the printer.
Figure 3B:
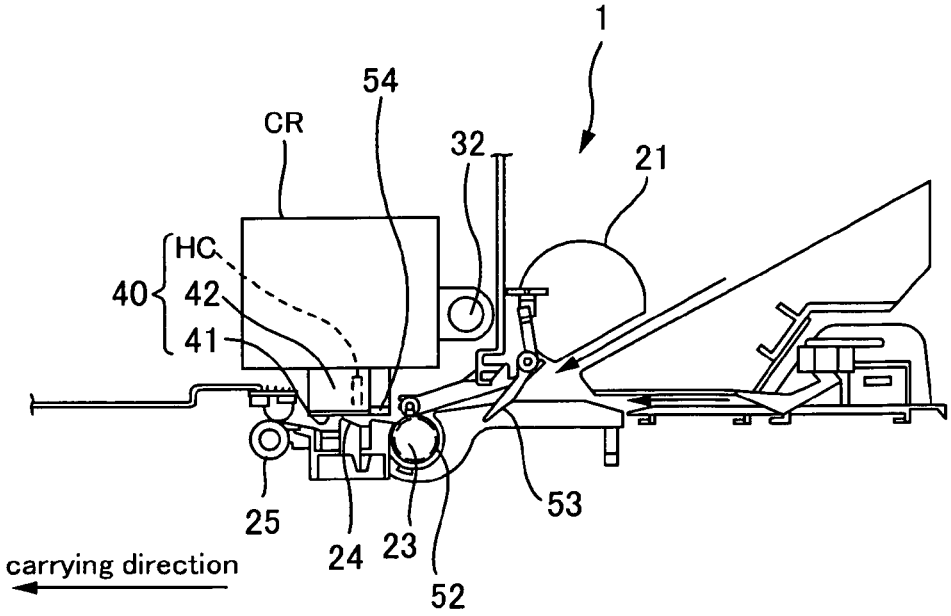
FIG. 3B is a lateral view illustrating the configuration of the printer.
Figure 4A:
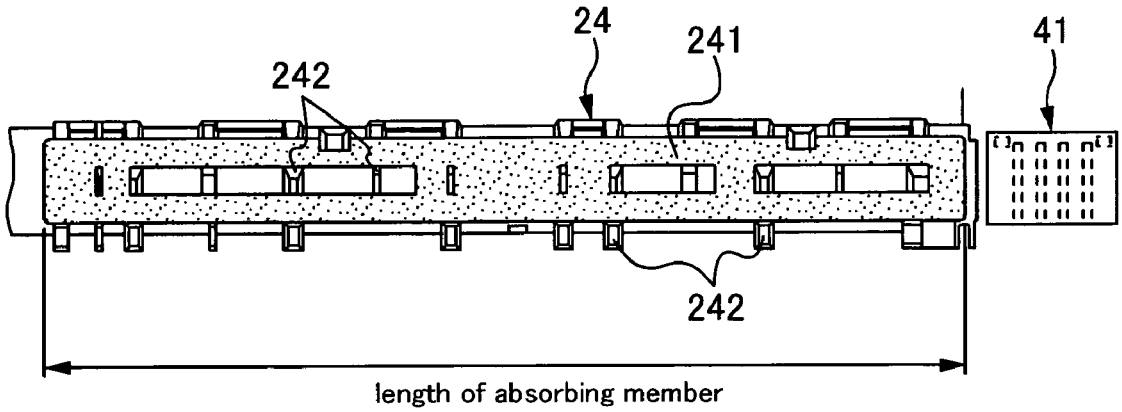
FIG. 4A is a plan view of a platen.
Figure 4B:
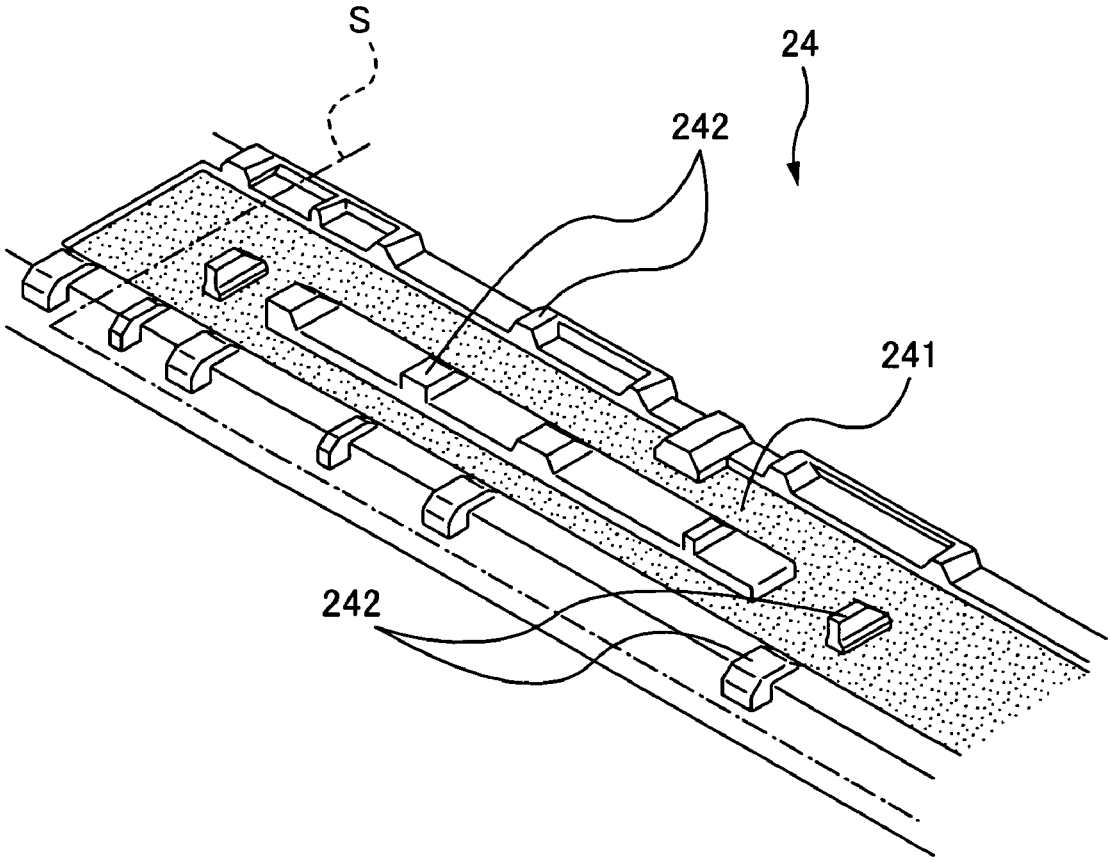
FIG. 4B is a perspective view showing a portion of the platen enlarged.

The configuration of the printer 1 is described next. Here, FIG. 3A is a diagram that shows the configuration of the printer 1 of the embodiment. FIG. 3B is a lateral view illustrating the configuration of the printer 1 of the embodiment. FIG. 4A is a plan view of a platen 24. FIG. 4B is a perspective view showing a portion of the platen 24 enlarged. It should be noted that FIG. 2 is also referred to in the following description.

As shown in FIG. 2, the printer 1 has a paper carry mechanism 20, a carriage movement mechanism 30, a head unit 40, a detector group 50, a printer-side controller 60, and a drive signal generation circuit 70. It should be noted that in this embodiment the printer-side controller 60 and the drive signal generation circuit 70 are provided in a common controller board CTR. Further, the head unit 40 has a head controller HC and a head 41.

In the printer 1, the printer-side controller 60 controls the control targets, that is, the paper carry mechanism 20, the carriage movement mechanism 30, the head unit 40 (the head controller HC and the head 41), and the drive signal generation circuit 70. Thus, the printer-side controller 60 causes an image to be printed on a paper S based on the print data obtained from the computer 110. The detectors of the detector group 50 monitor conditions within the printer 1. The detectors output the result of this detection to the printer-side controller 60. The printer-side controller 60 receives the detection results from the detectors and controls the control targets based on those detection results.

<Regarding Paper Carry Mechanism 20>

The paper carry mechanism 20 corresponds to the medium carry section for carrying media. The paper carry mechanism 20 feeds the paper S, which is a medium, up to a printable position, as well as carries the paper S by a predetermined carry amount in the carrying direction. The carrying direction is a direction that intersects the carriage movement direction described below. As shown in FIG. 3A and FIG. 3B, the paper carry mechanism 20 has a paper supply roller 21, a carry motor 22, a carry roller 23, the platen 24, and a discharge roller 25. The paper supply roller 21 is a roller for automatically delivering a paper S that has been inserted into a paper insertion opening into the printer 1, and in this example has a cross-sectional shape that resembles the letter D. The carry motor 22 is a motor for carrying the paper S in the carrying direction, and its operation is controlled by the printer-side controller 60. The carry roller 23 is a roller for carrying the paper S that has been delivered by the paper supply roller 21 up to a printable region. The operation of the carry roller 23 is also controlled by the carry motor 22. The discharge roller 25 is a roller for carrying the paper S for which printing has ended.

The platen 24 is a member that supports the paper S being printed from its back surface. As shown in FIG. 4A, the platen 24 of the present embodiment is provided with an ink absorbing member 241 for absorbing the ink. Herein, the "ink" is liquid-form ink ejected from nozzles Nz (see FIG. 5) provided in a head 41. Accordingly, the "ink" corresponds to a "liquid" ejected from the nozzles Nz. Further, the ink absorbing member 241 corresponds to a "liquid absorbing member" for absorbing the liquid. The ink absorbing member 241 is made of sponge, for example, and is used when ink ejected outside the paper is to be absorbed. The ink absorbing member 241 is spread and laid in the width direction of the paper S, and its length is designed to be longer than the width of the paper S. As shown in FIG. 4B, during printing, the paper S is arranged inside the range in which the ink absorbing member 241 has been spread and laid. That is, the ink absorbing member 241 is spread and laid up to a position beyond the side edge(s) of the paper S. Further, in order to keep the paper S and the ink absorbing member 241 from coming directly into contact with one another, the platen 24 is provided with a plurality of protrusions 242. The protrusions 242 protrude toward the upper side than the surface of the ink absorbing member 241, and the upper end surface of each protrusion comes into contact with the back surface of the paper S.

<Regarding Carriage Movement Mechanism 30>

The carriage movement mechanism 30 is for moving a carriage CR, to which the head unit 40 is attached, in a carriage movement direction. The carriage movement direction includes the direction of movement from one side to the other side and the direction of movement from that other side to the one side. It should be noted that the head unit 40 includes the head 41 and the head 41 is provided with the nozzles Nz. Therefore, the carriage movement direction corresponds to the nozzle movement direction, i.e., the "predetermined direction", in which the nozzles Nz are moved. Further, the carriage movement mechanism 30 corresponds to a "nozzle movement section" that moves the nozzles Nz in the predetermined direction.

The carriage movement mechanism 30 has a carriage motor 31, a guide shaft 32, a timing belt 33, a drive pulley 34, and a driven pulley 35. The carriage motor 31 corresponds to the drive source for moving the carriage CR. The operation of the carriage motor 31 is controlled by the printer-side controller 60. The drive pulley 34 is attached to the rotation shaft of the carriage motor 31, and is disposed on one end side in the carriage movement direction. The driven pulley 35 is disposed on the other end side in the carriage movement direction on the side opposite from the drive pulley 34. The timing belt 33 is connected to the carriage CR and is spanned across the drive pulley 34 and the driven pulley 35. The guide shaft 32 supports the carriage CR in a manner that permits movement thereof. The guide shaft 32 is attached in the carriage movement direction. Thus, operation of the carriage motor 31 causes the carriage CR to move in the carriage movement direction along the guide shaft 32.

<Regarding Head Unit 40>

The head unit 40 is for ejecting ink toward the paper S. The head unit 40 is attached to the carriage CR. The head 41 of the head unit 40 is provided on the lower surface of a head case 42, and the head controller HC of the head unit 40 is provided inside the head case 42. It should be noted that the head controller HC is described in greater detail later.

Figure 5:
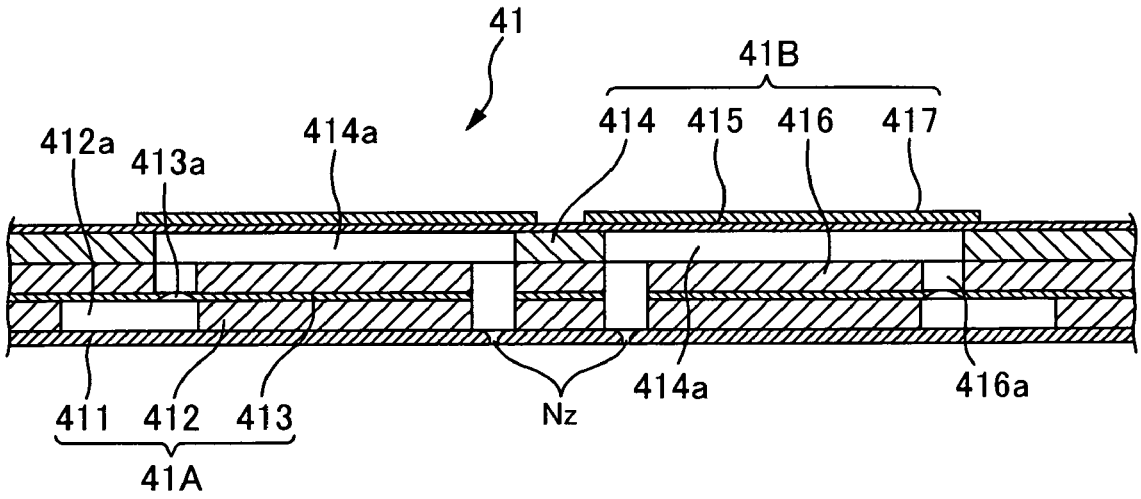
FIG. 5 is a cross-sectional view for describing a structure of a head.
Figure 6:
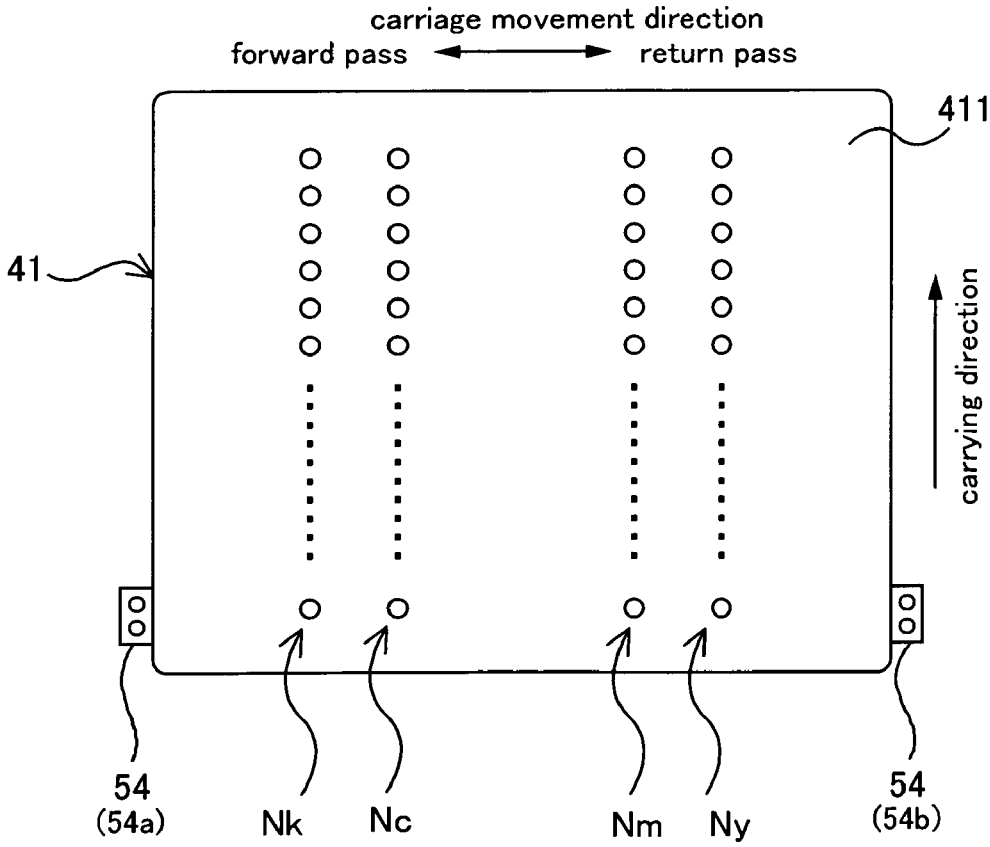
FIG. 6 is a diagram for describing an arrangement of nozzles of the head.

The structure of the head 41 is described next. Here, FIG. 5 is a cross-sectional view for describing the structure of the head 41. FIG. 6 is a diagram for describing an arrangement of the nozzles Nz of the head 41. The illustrative head 41 shown here has a channel unit 41A and an actuator unit 41B. The channel unit 41A has a nozzle plate 411 in which nozzles Nz are provided, a storage chamber formation substrate 412 in which open portions that become ink storage chambers 412*a* are formed, and a supply opening formation substrate 413 in which ink supply openings 413*a* are formed. The actuator unit 41B has a pressure chamber formation substrate 414 in which open portions that become pressure chambers 414*a* are formed, a vibration plate 415 that defines a portion of the pressure chambers 414*a*, a lid member 416 in which open portions that become supply-side communication openings 416*a* are formed, and piezo elements 417 formed on the surface of the vibration plate 415. A series of channels leading from the ink storage chambers 412*a* to the nozzles Nz through the pressure chambers 414*a* are formed in the head 41. At the time of use, the channels become filled with ink, and by deforming the piezo elements 417, ink can be ejected from the corresponding nozzles Nz.

In the head 41, nozzles Nz are lined up in the carrying direction of the paper S at a predetermine pitch, thus forming a nozzle row. Accordingly, the carrying direction of the paper S corresponds to the "other predetermined direction intersecting with the predetermined direction". A plurality of these nozzle rows are provided at different positions in the carriage movement direction, which is the predetermined direction. It can also be stated that a plurality of the nozzles Nz are provided at different positions in the carriage movement direction. One piezo element 417 is provided for each nozzle Nz, and the piezo elements 417 function as elements that can execute an operation for ejecting ink. In this head 41, the type of ink to be ejected can be set for each nozzle row. The head 41 of the present embodiment has, from the left in FIG. 6, a first nozzle row Nk for ejecting black ink, a second nozzle row Nc for ejecting cyan ink, a third nozzle row Nm for ejecting magenta ink, and a fourth nozzle row Ny for ejecting yellow ink.

With the printer 1, as discussed above, four types of control are possible, these being no dot formation corresponding to pixel data SI having a data value "00", formation of a small dot corresponding to the data value "01", formation of a medium dot corresponding to the data value "10", and formation of a large dot corresponding to the data value "11". Thus, it is possible to eject a plurality of types of ink in differing quantities from the nozzles Nz. For example, from each nozzle Nz, it is possible to eject three different ink types, these being ink of a quantity that allows the formation of a large dot (i.e., a large ink droplet), ink of a quantity that allows the formation of a medium dot (i.e., a medium ink droplet), and ink of a quantity that allows the formation of a small dot (i.e., a small ink droplet).

Regarding Detector Group 50>

The detector group 50 is for monitoring the conditions within the printer 1. As shown in FIG. 3A and FIG. 3B, the detector group 50 includes a linear encoder 51, a rotary encoder 52, a paper detector 53, and paper width detectors 54. The linear encoder 51 is for detecting the position of the carriage CR (head 41, nozzles Nz) in the carriage movement direction, and outputs a pulse signal every time, for example, the carriage CR is moved for a predetermined distance (for example, 1/180 inch). The pulse signal is also referred to as a PTS signal. For convenience, in the following description, the pulse signal output from the linear encoder 51 is referred to also as a PTS signal. The rotary encoder 52 is for detecting the amount of rotation of the carry roller 23. The paper detector 53 is for detecting the position of the front end of the paper S being printed. The paper width detectors 54 are for detecting the width of the paper S being printed. In other words, the detectors 54 are sensors that detect the paper S serving as the targeted object. Accordingly, the paper width detectors 54 corresponds to a "sensor that detects whether or not the targeted object is present". As shown in FIG. 6, in the present embodiment, the paper width detectors 54 are provided in a pair, one on each side surface of the head case 42. More specifically, a first paper width detector 54*a* is provided on the side surface of the head case 42 that faces toward the front when the carriage CR is moving in the forward-pass direction, and a second paper width detector 54b is provided on the side surface of the head case 42 that faces toward the front when the carriage CR is moving in the return-pass direction.

<Regarding Printer-Side Controller 60>

The printer-side controller 60 performs control of the printer 1. As shown in FIG. 2, the printer-side controller 60 has an interface section 61, a CPU 62, a memory 63, and a control unit 64. The interface section 61 sends and receives data to and from the computer 110, which is an external device. The CPU 62 is a computation processing device for performing the overall control of the printer 1. The memory 63 is for reserving a working area and an area for storing the programs of the CPU 62, and is constituted by a storage element such as a RAM, EEPROM, or ROM. The CPU 62 controls the control targets in accordance with computer programs stored on the memory 63. For example, the CPU 62 controls the paper carry mechanism 20 and the carriage movement mechanism 30 via the control unit 64.

The CPU 62 also outputs head control signals for controlling the operation of the head 41 to the head controller HC and outputs control signals for causing the generation of drive signals COM to the drive signal generation circuit 70. The head control signals, as shown for example in FIG. 8, are a transfer clock CLK, pixel data SI, a latch signal LAT, a first change signal CH_A, a second change signal CH_B, and a flushing control signal FL. By using such head control signals, the printer-side controller 60 can selectively apply, to the piezo elements 417, the drive pulses (corresponding to "ejection pulses") included in the drive signal COM, although this will be described in detail later on. Accordingly, the printer-side controller 60 corresponds to a "controller" for applying drive pulses (ejection pulses) to the piezo elements 417. The control signal for causing the generation of a drive signal COM is for example a DAC value. The DAC value is information for instructing a voltage of the signal to be output from a first drive signal generation section 70A and a second drive signal generation section 70B (see FIG. 7A) of the drive signal generation circuit 70, and is updated at a very short update cycle. The DAC value is also a type of generation information for causing the generation of a drive signal COM.

<Regarding Drive Signal Generation Circuit 70>

The drive signal generation circuit 70 is for generating drive signals COM that are used in common among the piezo elements 417, and corresponds to a "drive signal generation section". In this embodiment, the drive signals COM generated by the drive signal generation circuit 70 are used in common also for the plurality of nozzle rows. More specifically, a single drive signal generation circuit 70 generates the drive signals COM used by all of the piezo elements 417, which are provided corresponding to the four nozzle rows Nk to Ny.

Figure 7A:
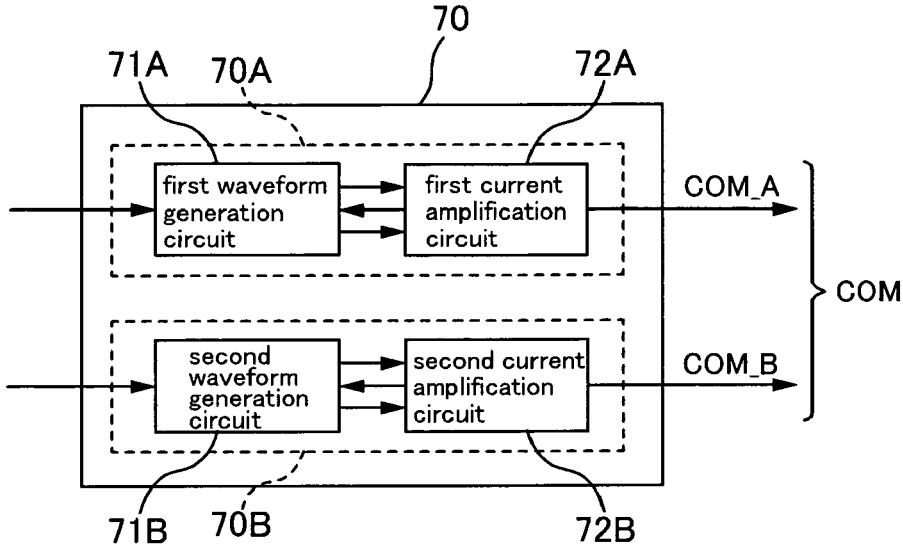
FIG. 7A is a block diagram for describing a configuration of a drive signal generation circuit.

Here, FIG. 7A is a block diagram illustrating the configuration of the drive signal generation circuit 70. The drive signal generation circuit 70 simultaneously generates a plurality of types of drive signals COM at least in a certain period (for example, cycle T). The drive signal generation circuit 70 of this embodiment has a first drive signal generation section 70A that generates a first drive signal COM_A and a second drive signal generation section 70B that generates a second drive signal COM_B. The first drive signal generation section 70A has a first waveform generation circuit 71A that generates a signal having a voltage that corresponds to the DAC value (generation information), and a first current amplification circuit 72A that amplifies the current of the signal that is generated by the first waveform generation circuit 71A. The second drive signal generation section 70B has a second waveform generation circuit 71B and a second current amplification circuit 72B. It should be noted that the first waveform generation circuit 71A and the second waveform generation circuit 71B have the same structure, and that the first current amplification circuit 72A and the second current amplification circuit 72B have the same structure.

<Regarding the Generated Drive Signals COM>

Figure 7B:
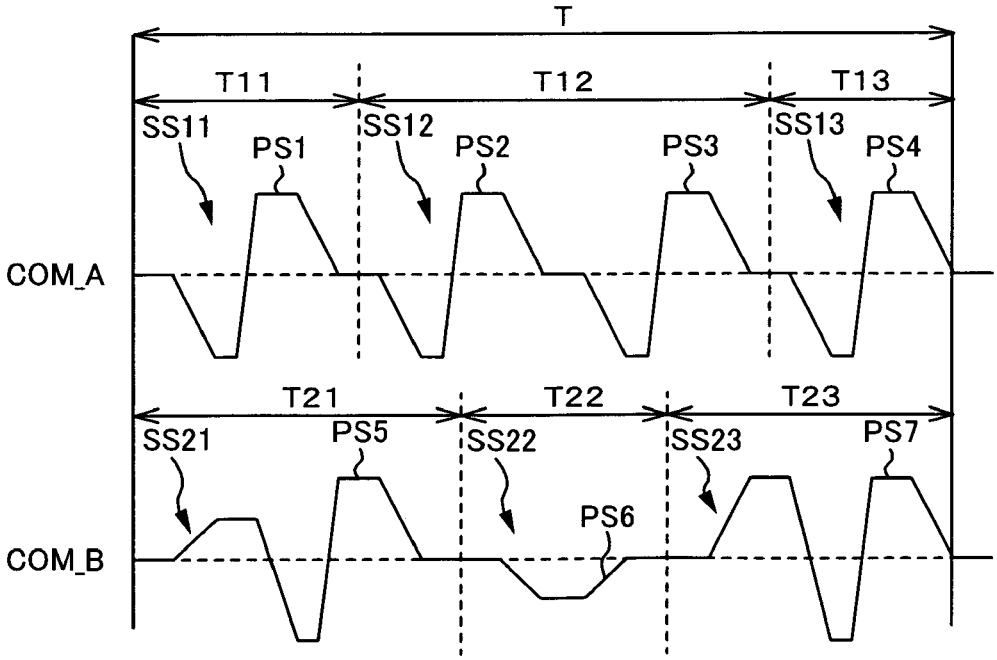
FIG. 7B is a diagram describing a first drive signal and a second drive signal generated by the drive signal generation circuit.

The drive signals COM that are generated by the drive signal generation circuit 70 are described next. FIG. 7B is a diagram describing the first drive signal COM_A and the second drive signal COM_B generated by the drive signal generation circuit 70. In the printing operation period, the drive signal generation circuit 70 simultaneously generates a first drive signal COM_A and a second drive signal COM_B. That is, the first waveform generation circuit 70A generates the first drive signal COM_A based on a first DAC value (this corresponds to the first generation information). Similarly, the second waveform generation section 70B generates the second drive signal COM_B based on a second DAC value (this corresponds to the second generation information).

The first drive signal COM_A has a first waveform section SS11 that is generated during a period T11 of a repeating cycle T, a second waveform section SS12 that is generated in a period T12, and a third waveform section SS13 that is generated in a period T13. Here, the first waveform section SS11 has a drive pulse PS1. Similarly, the second waveform section SS12 has drive pulses PS2 and PS3, and the third waveform section SS13 has a drive pulse PS4. The drive pulses PS1 through PS4 are applied to the piezo elements 417 when a large dot is to be formed. That is, these drive pulses are applied to the piezo element 417 when ink for forming a large dot is to be ejected from a nozzle Nz. Accordingly, the drive pulses PS1 through PS4 can be expressed as a "large-dot drive pulse" for forming a large dot. In the present embodiment, these drive pulses PS1 through PS4 each have the same waveform. The drive pulses PS2 and PS3 are also applied to a piezo element 417 when a medium dot is to be formed. That is, these drive pulses are applied to the piezo element 417 when ink for forming a medium dot is to be ejected from a nozzle Nz. Accordingly, the drive pulses PS2 and PS3 can be expressed as a "medium-dot drive pulse" for forming a medium dot.

The second drive signal COM_B has a first waveform section SS21 that is generated in a period T21, a second waveform section SS22 that is generated in a period T22, and a third waveform section SS23 that is generated in a period T23. The second drive signal COM_B has a drive pulse PS5 in the first waveform section SS21, has a drive pulse PS6 in the second waveform section SS22, and a drive pulse PS7 in the third waveform section SS23. The drive pulse PS5 is applied to the piezo element 417 when a small dot is to be formed, that is, when ink for forming a small dot is to be ejected from a nozzle Nz. Accordingly, the drive pulse PS5 can be expressed as a "small-dot drive pulse" for forming a small dot. The drive pulse PS6 is applied to the piezo element 417 when no dot is to be formed. When the drive pulse PS6 is applied to the piezo element 417, the piezo element 417 deforms to an extent that ink is not ejected, and thereby the meniscus (the free surface of the ink exposed from the nozzle Nz) is slightly vibrated and the ink is stirred. Accordingly, the drive pulse PS6 can be expressed as a "micro-vibration drive pulse" for slightly vibrating the meniscus.

The drive pulse PS7 is applied to the piezo element 417 when thickened ink is to be ejected to an area outside the paper. When the drive pulse PS7 is applied to the piezo element 417, ink is ejected from the nozzle Nz. This ink ejection is for the purpose of efficiently discharging the thickened ink, which exists in the nozzle Nz, to the outside of the nozzle Nz. The operation of ejecting the thickened ink from the nozzle Nz is referred to also as "flushing operation". Accordingly, the drive pulse PS7 can be expressed as a "flushing drive pulse" for causing the flushing operation. The waveform of the drive pulse PS7 is designed mainly focusing on increasing the flow velocity inside the nozzle Nz as much as possible and ensuring an ejection amount that allows the thickened ink to be discharged. In this aspect, the drive pulse PS7 is different from the first drive pulse PS1 through the fifth drive pulse PS5, whose waveforms are designed mainly focusing on increasing the precision in the landing positions and the precision in the ejection amount.

In this example, the first drive pulse PS1 through the fourth drive pulse PS4 are used for ejecting the ink toward the paper S, which serves as the targeted object, and are included in the first drive signal COM_A. Accordingly, these correspond to a "first ejection pulse" for ejecting the liquid onto the targeted object. Further, the fifth drive pulse PS5 is used for ejecting the ink toward the paper S, which serves as the targeted object, and is included in the second drive signal COM_B, in which the seventh drive pulse serving as the flushing drive pulse is included. Accordingly, the fifth drive pulse corresponds to an "other first ejection pulse" for ejecting the liquid onto the targeted object. Further, the seventh drive pulse PS7 is for ejecting the thickened ink outside the paper S, that is, toward the ink absorbing member 241. Accordingly, the seventh drive pulse corresponds to a "second ejection pulse" for ejecting the thickened ink outside the targeted object.

Each waveform section in the first drive signal COM_A and the second drive signal COM_B can be applied individually to the piezo elements 417. That is, a portion of the first drive signal COM_A and the second drive signal COM_B can be applied selectively to each of the piezo elements 417. The first drive signal COM_A and the second drive signal COM_B, however, cannot be applied at the same time. This is because if the first switch 86A (see FIG. 8) and the second switch 86B (also see FIG. 8) are brought into the connected state at the same time, a flow-through current that flows between the first drive signal generation section 70A and the second drive signal generation section 70B may be generated, and the flow-through current may cause problems in the first drive signal generation section 70A and/or the second drive signal generation section 70B. Focusing on this point, in the present embodiment, the drive pulse PS7 (i.e., the second ejection pulse) used for the flushing operation is generated in a period in which the drive pulses PS3 and PS4 (i.e., the first ejection pulses) used at the time of forming a medium dot and/or a large dot are being generated. In this way, many drive pulses can be included, even in a limited repeating cycle T, and thus the drive pulses can each be generated efficiently. Further, in the present embodiment, the second drive signal COM_B includes the drive pulse PS7 used for the flushing operation, the drive pulse PS5 (i.e., the other first ejection pulse) used when forming a small dot, and the drive pulse PS6 used when slightly vibrating the meniscus. From this aspect also, the drive pulses can each be generated efficiently. Further, since it is possible to increase the number of drive pulses used during printing, even in a limited repeating cycle T, the degree of freedom regarding the amount of ink to be ejected can be increased.

The application control of each of the waveform sections (each of the drive pulses) is performed based on latch pulses in the latch signal LAT, change pulses in the first change signal CH_A, and change pulses in the second change signal CH_B. The application control is described later on.

<Regarding Head Controller HC>

Figure 9:
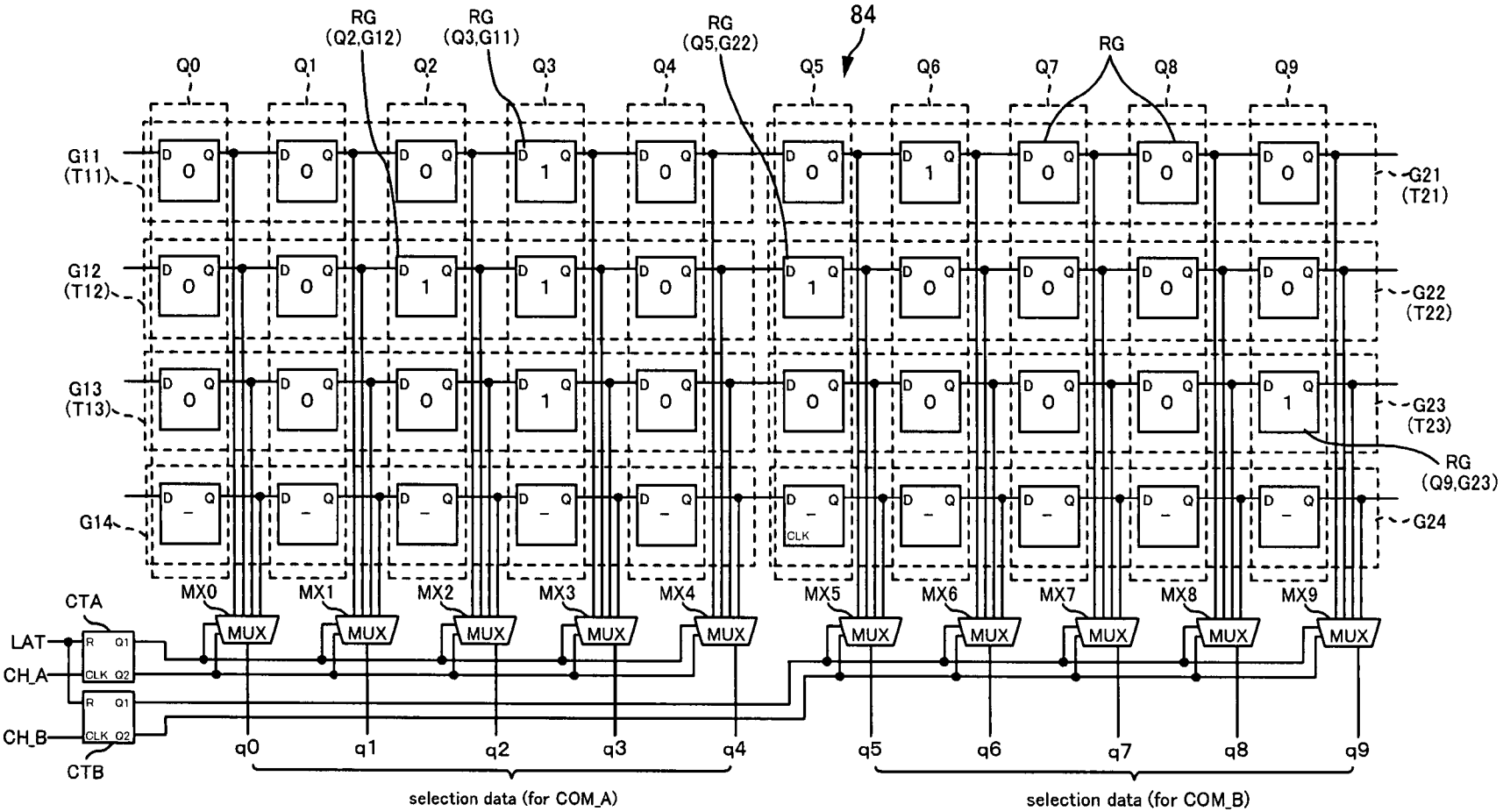
FIG. 9 is an explanatory diagram of a control logic.
Figure 10:
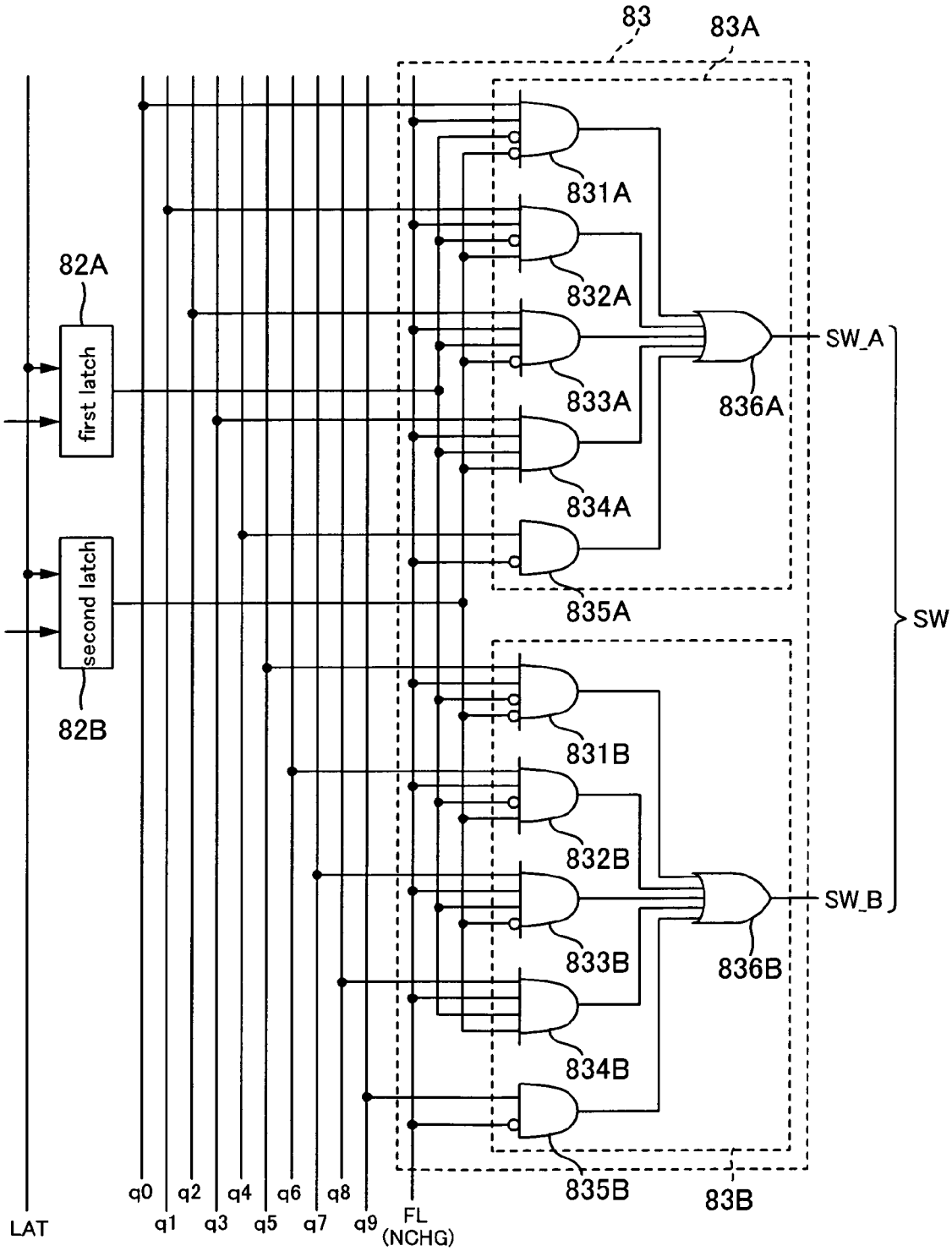
FIG. 10 is an explanatory diagram of a decoder.

The head controller HC is described next. Here, FIG. 8 is a block diagram that describes the configuration of the head controller HC. FIG. 9 is an explanatory diagram of a control logic 84. FIG. 10 is an explanatory diagram of a decoder 83.

In the present embodiment, the head controller HC is provided for each nozzle row. Accordingly, the printer 1 has four head controllers HC shown in FIG. 8. The head controller HC is provided with first shift registers 81A, second shift registers 81B, first latch circuits 82A, second latch circuits 82B, decoders 83, a control logic 84, first switches 86A, and second switches 86B. Each of the sections other than the control logic 84 (that is, the first shift register 81A, the second shift register 81B, the first latch circuit 82A, the second latch circuit 82B, the decoder 83, the first switch 86A, and the second switch 86B) is provided for each one of the piezo elements 417. The pair of the first switch 86A and the second switch 86B provided for the same piezo element 417 corresponds to a switch section. Because a piezo element 417 is provided for each nozzle Nz from which ink is ejected, each of these sections is provided for each nozzle Nz.

The head controller HC performs control for ejecting ink based on the head control signals from the printer-side controller 60. That is, the head controller HC controls the first switches 86A and the second switches 86B based on the pixel data SI and the flushing control signal FL and causes the necessary sections of the first drive signal COM_A and the second drive signal COM_B to be selectively applied to the piezo elements 417. In this embodiment, each pixel data SI is made of two bits, and the flushing control signal FL is made of one bit (i.e., H level or L level). Further, the pixel data SI are delivered to the recording head 41 in synchronization with the transfer clock CLK. Of the pixel data SI that have been sent, the high-order bit group is set in the first shift registers 81A, and the low-order bit group is set in the second shift registers 81B.

The first shift registers 81A are electrically connected to the first latch circuits 82A, and the second shift registers 81B are electrically connected to the second latch circuits 82B. When the latch signal LAT from the printer-side controller 60 becomes the high (H) level (that is, when a latch pulse is applied), then the first latch circuit 82A latches the high-order bit of the corresponding pixel data SI and the second latch circuit 82B latches the low-order bit of the corresponding pixel data SI. Each pixel data SI that has been latched by the first latch circuit 82A and the second latch circuit 82B (the pair of the high-order bit and the low-order bit) is input to the decoder 83.

The decoder 83 performs a decoding operation based on the high-order bit and the low-order bit of the pixel data SI and the flushing control signal FL, and outputs switch control signals SW (first switch control signal SW_A and second switch control signal SW_B; see FIG. 10) for controlling the first switch 86A and the second switch 86B. Outputting of the switch control signals SW is performed by selecting selection data q0 through q9 output from the control logic 84 based on the combination of the flushing control signal FL and the pixel data SI that has been latched by the first latch circuit 82A and the second latch circuit 82B. The output of the switch control signals SW will be described in detail further below.

The control logic 84 and the selection data q0 through q9 stored on the control logic 84 are described next. As shown in FIG. 9, the control logic 84 has a plurality of registers RG each capable of storing one bit of data. Each register RG is constituted by a D-FF (delay flip flop) circuit or the like. Each register RG stores predetermined selection data. The contents of the selection data is changed if the print mode is changed, for example.

For the sake of simplifying the description, in FIG. 9 the registers RG are disposed in a matrix of four registers in the column direction (vertical direction) and ten registers in the row direction (horizontal direction). The four registers RG belonging to the same column are grouped together, and starting from the group on the left are assigned numbers Q0 through Q9. The registers RG are divided between register groups located on the left side in the row direction (groups Q0 to Q4) and register groups located on the right side in the row direction (groups Q5 to Q9). Regarding the register groups located on the left side, the five registers RG belonging to the same row are grouped together and assigned numbers G11 to G14 in order from the group located at the top. Likewise, regarding the register groups located on the right side, the registers are assigned numbers G21 to G24 in order from the group located at the top.

The above groupings are made based on the role of the registers RG. First, the registers RG belonging to the groups Q0 to Q4 located on the left side in the row direction are capable of storing first selection data q0 to q4 for the first drive signal COM_A. Similarly, the registers RG belonging to the groups Q5 to Q9 located on the right side in the row direction are capable of storing second selection data q5 to q9 for the second drive signal COM_B.

Furthermore, the registers RG belonging to the same column can store selection data used for the same ejection operation. To describe this more specifically, the registers RG belonging to the group Q0 and the group Q5 are capable of storing selection data q0 and q5, respectively, which correspond to the pixel data SI for no dot formation (non-ejection of ink) (data value "00"). The registers RG belonging to the group Q1 and the group Q6 are capable of storing selection data q1 and q6, respectively, which correspond to the pixel data SI indicating ink ejection for a small dot (formation of a small dot) (data value "01"). Similarly, the registers RG belonging to the group Q2 and the group Q7 are capable of storing selection data q2 and q7, respectively, which correspond to the pixel data SI indicating ink ejection for a medium dot (formation of a medium dot) (data value "10"), and the registers RG belonging to the group Q3 and the group Q8 are capable of storing selection data q3 and q8, respectively, which correspond to the pixel data SI indicating ink ejection for a large dot (formation of a large dot) (data value "11"). In addition, the registers RG belonging to the group Q4 and the group Q9 are capable of storing selection data q4 and q9, respectively, which correspond to the flushing control signal FL indicating ink ejection for the flushing operation (data "0").

Further, the registers RG belonging to the same row can store selection data of the same waveform section. More specifically, the registers RG belonging to the group G11 can store selection data for the first waveform section SS11, which is generated in the period T11. Likewise, the registers RG belonging to the group G12 can store selection data for the second waveform section SS12, which is generated in the period T12. Furthermore, the registers RG belonging to the group G13 can store selection data for the third waveform section SS13, which is generated in the period T13. It should be noted that the registers RG belonging to the group G14 are not used in this embodiment. In a case where the first drive signal COM_A is made of four waveform sections, then the registers RG of this group G14 store the selection data for a fourth waveform section. In a similar manner, the registers RG belonging to the group G21 store the selection data for the first waveform section SS21, which is generated in period T21, the registers RG belonging to the group G22 store the selection data for the second waveform section SS22, which is generated in period T22, and the registers RG belonging to the group G23 store the selection data for the third waveform section SS23, which is generated in period T23. In this embodiment, the registers RG belonging to the group G24 are not used.

To summarize the above, the registers RG of the control logic 84 can be said to store selection data determined by factors including the type of the corresponding drive signal COM (first drive signal COM_A, second drive signal COM_B), the corresponding pixel data SI (data value "00" through data value "11"), whether or not the flushing operation is necessary (data "0" or data "1"), and the corresponding waveform section (first waveform section SS11, second waveform section SS22, and so forth).

For example, the register RG (Q2, G12) belonging to both group Q2 and group G12 stores the selection data corresponding to the second waveform section SS12 of the first drive signal COM_A in pixel data SI for a medium dot (data value "10"). The register RG (Q3, G11) belonging to both group Q3 and group G11 stores selection data corresponding to the first waveform section SS11 of the first drive signal COM_A in pixel data SI for a large dot (data value "11"). Similarly, the register RG (Q5, G22) belonging to both group Q5 and group G22 stores selection data corresponding to the second waveform section SS22 of the second drive signal COM_B in pixel data SI for no dot (data value "00"). Further, the register RG (Q9, G23) belonging to both group Q9 and group G23 stores selection data corresponding to the third waveform section SS23 of the second drive signal COM_B in the flushing control signal FL during the flushing operation (data "0").

Due to multiplexers MX0 through MX9, the selection data stored on the registers RG are successively selected at a timing defined by the latch pulse of the latch signal LAT, the change pulse of the first change signal CH_A, and the change pulse of the second change signal CH_B. That is, the timing defined by these pulses corresponds to the switch timing of the waveform data. It should be noted that in the present embodiment, the selection operation by the multiplexers MX0 to MX9 is controlled by the output from counters CTA and CTB to which the latch pulse and the change pulses are input. The selection data that have been selected by the multiplexers MX0 to MX9 are then output as first selection data q0 to q4 for the first drive signal COM_A and second selection data q5 to q9 for the second drive signal COM_B.

The decoder 83 is described next. As shown in FIG. 10, the decoder 83 selects the selection data, from among the first selection data q0 to q4 and the second selection data q5 to q9, that correspond to the pixel data SI that have been latched and the flushing control signal FL, and outputs these as a switch control signal SW. The decoder 83 has a first decoding section 83A that outputs a first switch control signal SW_A and a second decoding section 83B that outputs a second switch control signal SW_B.

The first decoding section 83A has five AND gates 831A to 835A, and a single OR gate 836A. Each AND gate 831A to 834A has four input terminals and one output terminal. The AND gate 835A has two input terminals and one output terminal.

The AND gate 831A receives, as its input, the first selection data q0 for no-dot formation, the flushing control signal FL, the inverted data of the high-order bit, and the inverted data of the low-order bit of the pixel data SI. Thus, if the pixel data SI are the data value "00" and the flushing control signal FL is data "1" meaning disable, then the output from the AND gate 831A is in accordance with the first selection data q0 for no-dot formation.

The AND gate 832A receives, as its input, the first selection data q1 for a small dot, the flushing control signal FL, the inverted data of the high-order bit, and the data of the low-order bit of the pixel data SI. Thus, if the pixel data SI are the data value "01" and the flushing control signal FL is data "1" meaning disable, then the output from the AND gate 832A is in accordance with the first selection data q1 for a small dot.

The AND gate 833A receives, as its input, the first selection data q2 for a medium dot, the flushing control signal FL, the data of the high-order bit, and the inverted data of the low-order bit of the pixel data SI. Thus, if the pixel data SI are the data value "10" and the flushing control signal FL is data "1" meaning disable, then the output from the AND gate 833A is in accordance with the first selection data q2 for a medium dot.

The AND gate 834A receives, as its input, the first selection data q3 for a large dot, the flushing control signal FL, the data of the high-order bit, and the data of the low-order bit of the pixel data SI. Thus, if the pixel data SI are the data value "11" and the flushing control signal FL is data "1" meaning disable, then the output from the AND gate 834A is in accordance with the first selection data q3 for a large dot.

The AND gate 835A receives, as its input, the first selection data q4 for the flushing operation and the inverted data of the flushing control signal FL. Thus, if the flushing control signal FL is data "0" meaning enable, then the output from the AND gate 835A is in accordance with the first selection data q4 for the flushing operation, irrespective of the contents of the pixel data SI. It should be noted that when the flushing control signal FL is data "0" meaning enable, the output of the other AND gates 831A to 834A becomes data "0", irrespective of the pixel data SI. That is, the output of the AND gates 831A to 834A can be said to be masked by the data "0" of the flushing control signal FL indicating execution.

The OR gate 836A has five input terminals and one output terminal. Its five input terminals receive the output of the AND gates 831A to 835A, respectively. The OR gate 836A outputs a first switch control signal SW_A. That is, it outputs the first selection data, of among the first selection data q0 to q4, that corresponds to the latched pixel data SI and the flushing control signal FL as the first switch control signal SW_A.

The second decoding section 83B also has five AND gates 831B to 835B and a single OR gate 836B. The second decoding section 83B has the same configuration as the first decoding section 83A. That is, the AND gate 831B receives, as its input, the second selection data q5 for no-dot formation, the flushing control signal FL, the inverted data of the high-order bit, and the inverted data of the low-order bit of the pixel data SI. The AND gate 832B receives, as its input, the second selection data q6 for a small dot, the flushing control signal FL, the inverted data of the high-order bit, and the data of the low-order bit of the pixel data SI. The AND gate 833B receives, as its input, the second selection data q7 for a medium dot, the flushing control signal FL, the data of the high-order bit, and the inverted data of the low-order bit of the pixel data SI. The AND gate 834B receives, as its input, the second selection data q8 for a large dot, the flushing control signal FL, the data of the high-order bit, and the data of the low-order bit of the pixel data SI. The AND gate 835B receives, as its input, the second selection data q9 for the flushing operation and the inverted data of the flushing control signal FL. The OR gate 836B receives the output of the five AND gates 831B to 835B. In this way, the OR gate 836B outputs the second selection data, of among the second selection data q5 to q9, that corresponds to the latched pixel data SI and the flushing control signal FL as a second switch control signal SW_B.

The first switch control signal SW_A and the second switch control signal SW_B that are output from the decoder 83 are input to the first switch 86A and the seconds witch 86B. The first switch 86A and the second switch 86B switch between an ON state and an OFF state by changing their resistance. For example, in the ON state their resistance is on the order of 100Ω, whereas in the OFF state their resistance is on the order of several ten MΩ. The first drive signal. COM_A from the drive signal generation circuit 70 is applied to the input side of the first switch 86A, and the second drive signal COM_B is applied to the input side of the second switch 86B. The piezo element 417 is electrically connected to the output side of both the first switch 86A and the second switch 86B. The first switch 86A and the second switch 86B are switches that are provided for each drive signal COM that is generated. The first switch 86A controls application of the first drive signal COM_A to the piezo element 417, and the second switch 86B controls application of the second drive signal COM_B to the piezo element 417. The printer-side controller 60 controls these switches to selectively apply the waveform sections SS11 to SS13 making up the first drive signal COM_A and the waveform sections SS21 to SS23 making up the second drive signal COM_B to the corresponding piezo element 417.

Further, the first switch control signal SW_A controls the operation of the first switch 86A, and the second switch control signal SW_B controls the operation of the second switch 86B. That is, the first switch control signal SW_A corresponds to the switch control signal SW for the first switch 86A. Similarly, the second switch control signal SW_B corresponds to the other switch control signal SW for the second switch 86B. Specifically, if the first switch control signal SW_A takes the data value "1", then the first switch 86A becomes on and the first drive signal COM_A is applied to the piezo element 417. If the first switch control signal SW_A takes the data value "0", then the first switch 86A becomes off and thus the first drive signal COM_A is not applied to the piezo element 417. Similarly, if the second switch control signal SW_B takes the data value "1", then the second switch 86B becomes on and the second drive signal COM_B is applied to the piezo element 417. If the second switch control signal SW_B takes the data value "0", then the second switch 86B becomes off and thus the second drive signal COM_B is not applied to the piezo element 417. Easy control is achieved with the present embodiment because it is possible to apply the first drive signal COM_A and the second drive signal COM_B based on the switch control signals SW.

It should be noted that the piezo elements 417 act like capacitors. Thus, if application of the drive signal COM is stopped, then the piezo elements 417 retain the potential immediately before that stoppage. Therefore, during the time that application of a drive signal COM is stopped, the piezo elements 417 maintain the deformed state that they were in immediately prior to the stoppage of application of the drive signal COM.

<Regarding Ink Ejection Control>

Figure 11:
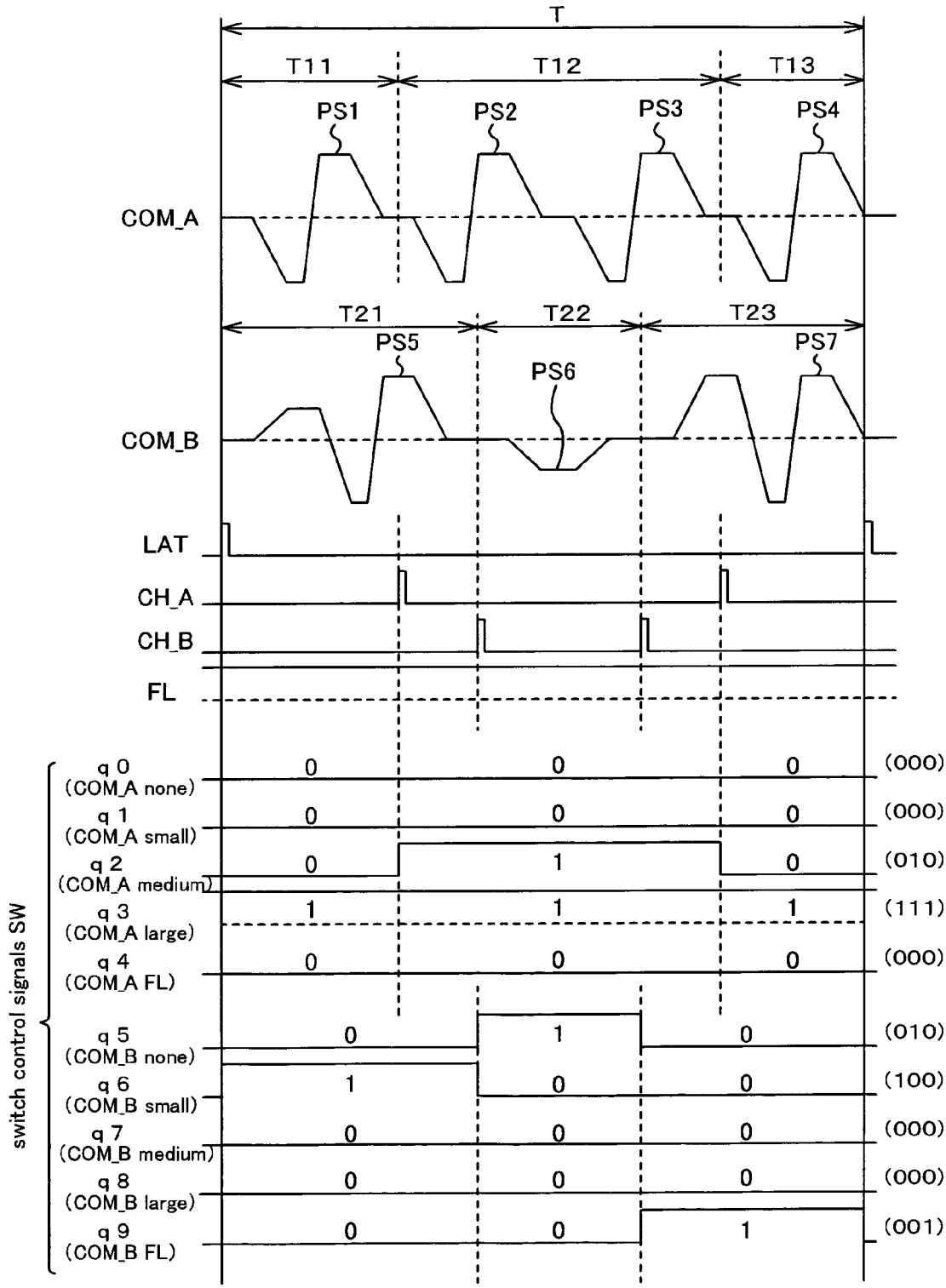
FIG. 11 is a diagram that describes the first drive signal, the second drive signal, and necessary control signals.
Figures 12A, 12B:
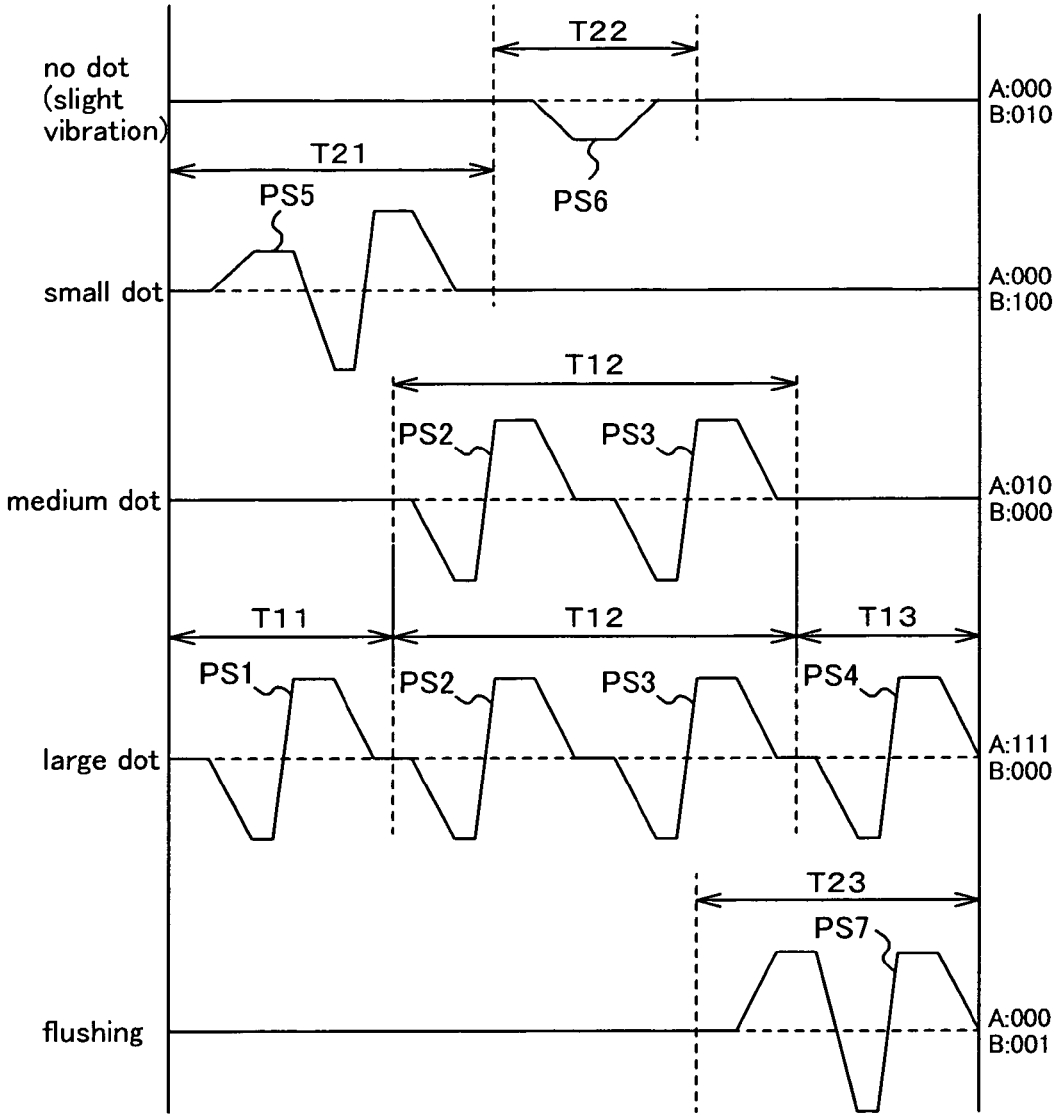
FIG. 12A is a diagram that illustrates waveform sections that are applied to a piezo element when forming no dot, when forming a small dot, when forming a medium dot, when forming a large dot, and when performing a flushing operation.
FIG. 12B is a diagram illustrating a relationship between combinations of pixel data and the flushing control signal and what kinds of operations are performed.

Ink ejection control in the printer 1 is described next. Here, FIG. 11 is a diagram that describes the first drive signal COM_A, the second drive signal COM_B, and the necessary control signals. FIG. 12A is a diagram illustrating the waveform sections that are applied to a piezo element 417 when forming no dot, when forming a small dot, when forming a medium dot, when forming a large dot, and when performing the flushing operation. FIG. 12B is a diagram illustrating a relationship between combinations of the pixel data SI and the flushing control signal FL and what kinds of operations are performed.

First, a case in which no dot is formed (i.e., when the pixel data SI is data "00" and the flushing control signal FL is data "1") will be described. In this case, the decoder 83 selects the first selection data q0 and the second selection data q5, and outputs these as the first switch control signal SW_A and the second switch control signal SW_B. In the present embodiment, the first switch control signal SW_A is data "000" and the second switch control signal SW_B is data "010". These data are output on a time series. As a result, as shown on the upper stage in FIG. 12A, the second drive signal COM_B is applied to the piezo element 417 in period T22 and the meniscus is slightly vibrated by the drive pulse PS6.

Next, a case in which a small dot is formed (i.e., when the pixel data SI is data "01" and the flushing control signal FL is data "1") will be described. In this case, the decoder 83 selects the first selection data q1 and the second selection data q6, and outputs these as the first switch control signal SW_A and the second switch control signal SW_B. In the present embodiment, the first switch control signal SW_A is data "000" and the second switch control signal SW_B is data "100". These data are output on a time series. As a result, as shown on the second stage from the top in FIG. 12A, the second drive signal COM_B is applied to the piezo element 417 in period T21 and ink of an amount corresponding to a small dot is ejected from the nozzle Nz by the drive pulse PS5.

Next, a case in which a medium dot is formed (i.e., when the pixel data SI is data "10" and the flushing control signal FL is data "1") will be described. In this case, the decoder 83 selects the first selection data q2 and the second selection data q7, and outputs these as the first switch control signal SW_A and the second switch control signal SW_B. In the present embodiment, the first switch control signal SW_A is data "010" and the second switch control signal SW_B is data "000". These data are output on a time series. As a result, as shown on the middle stage in FIG. 12A, the first drive signal COM_A is applied to the piezo element 417 in period T12 and ink of an amount corresponding to a medium dot is ejected from the nozzle Nz by the drive pulses PS2 and PS3.

Next, a case in which a large dot is formed (i.e., when the pixel data SI is data "11" and the flushing control signal FL is data "1") will be described. In this case, the decoder 83 selects the first selection data q3 and the second selection data q8, and outputs these as the first switch control signal SW_A and the second switch control signal SW_B. In the present embodiment, the first switch control signal SW_A is data "111" and the second switch control signal SW_B is data "000". These data are output on a time series. As a result, as shown on the second stage from the bottom in FIG. 12A, the first drive signal COM_A is applied to the piezo element 417 during the periods T11 through T13 and ink of an amount corresponding to a large dot is ejected from the nozzle Nz by the drive pulses PS1 through PS4.

Finally, a case in which the flushing operation is performed (i.e., when the flushing control signal FL is data "0") will be described. In this case, the decoder 83 selects the first selection data q4 and the second selection data q9, and outputs these as the first switch control signal SW_A and the second switch control signal SW_B. In the present embodiment, the first switch control signal SW_A is data "000" and the second switch control signal SW_B is data "001". These data are output on a time series. As a result, as shown on the bottom stage in FIG. 12A, the second drive signal COM_B is applied to the piezo element 417 in period T23 and ink of a state (amount and velocity) suitable for the flushing operation is ejected from the nozzle Nz by the drive pulse PS7.

<Regarding Printing Operation>

Figure 13:
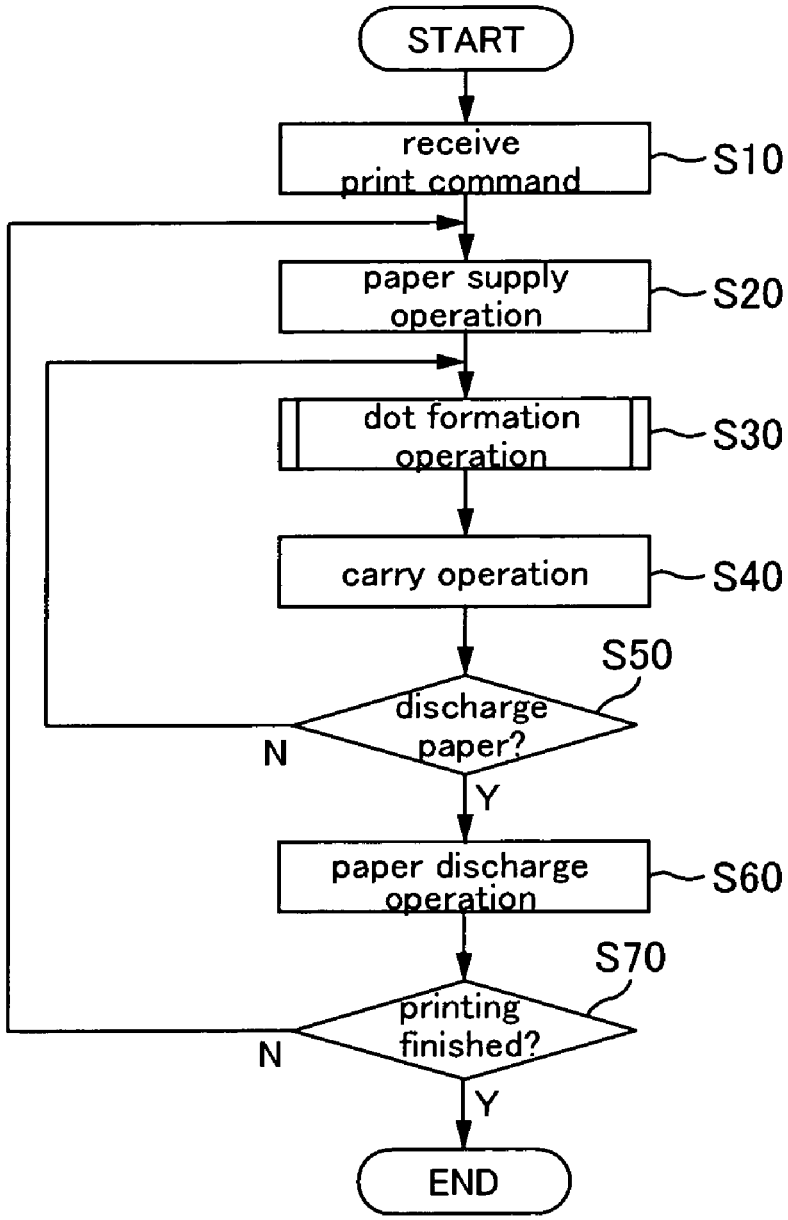
FIG. 13 is a flowchart describing a printing operation.

With the printer 1 having the above configuration, the printer-side controller 60 controls the control targets (the paper carry mechanism 20, the carriage movement mechanism 30, the head unit 40, and the drive signal generation circuit 70) in accordance with a computer program that is stored on the memory 63. Thus, this computer program has program codes for allowing execution of this control. An image is printed on a paper S by controlling the control targets. Here, FIG. 13 is a flowchart that describes the printing operation. This illustrative printing operation includes a print command receiving operation (S10), a paper supply operation (S20), a dot formation operation (S30), a carry operation (S40), a paper discharge determination (S50), a paper discharge process (S60), and a determination of whether or not printing is finished (S70). These operations are briefly described below.

The print command receiving operation (S10) is an operation of receiving a print command from the computer 110. In this operation, the printer-side controller 60 receives the print command through the interface section 61. The paper supply operation (S20) is an operation of moving the paper S, which is the subject targeted for printing, to position it at a print start position (the so-called indexed position). In this operation, the printer-side controller 60 drives the carry motor 22, for example, to rotate the paper supply roller 21 and the carry roller 23. The dot formation operation (S30) is an operation for forming dots on the paper S. In this operation, the printer-side controller 60 drives the carriage motor 31 and outputs control signals to the drive signal generation circuit 70 and the head 41. In this way, the first drive signal COM_A and the second drive signal COM_B described above are generated, and these drive signals COM are selectively applied to the piezo elements 417. Further, ink is ejected from the nozzles Nz while the head 41 is moving, forming dots on the paper S. In this dot formation operation, the flushing operation is also appropriately performed in order to prevent the ink in the nozzles Nz from thickening in viscosity. The carry operation (S40) is an operation of moving the paper S in the carrying direction. In this operation, the printer-side controller 60 drives the carry motor 22 to rotate the carry roller 23. Through this carry operation, it becomes possible to form dots at positions that are different from those dots formed in the previous dot formation operation. The paper discharge determination (S50) is an operation of determining whether or not it is necessary to discharge the paper S that is being printed. This determination is made by the printer-side controller 60 based on whether or not there are print data, for example. The paper discharge process (S60) is a process for discharging the paper S, and is performed if the result of the above-mentioned paper discharge determination is "discharge paper." In this case, the printer-side controller 60 causes rotation of the paper discharge roller 25 so that the paper S, for which printing has finished, is discharged to the outside. The print end determination (S70) is a determination of whether or not to continue printing. This determination also is performed by the printer-side controller 60.

<Regarding Flushing Operation>

As described above, in the period in which the dot formation operation is being performed, the flushing operation is also performed. In order to reduce the time required for the flushing operation as much as possible, in the present embodiment, the drive pulse PS7 used for the flushing operation is included in the second drive signal COM_B that is generated simultaneously with the first drive signal COM_A, as described above. By using the flushing control signal FL and the selection data q4 and q9 for the flushing operation, the drive pulse PS7 is applied to the piezo element 417 with the same control as that for when ejecting ink onto the paper S. In this way, it is possible to omit the control for changing the drive signals COM to be generated, such as from the drive signal COM for printing to the drive signal COM for the flushing operation. Thus, it is possible to eject the thickened ink, which has thickened in viscosity, outside the paper with a simple control. In this way, it is possible to improve processing efficiency.

Figure 14:
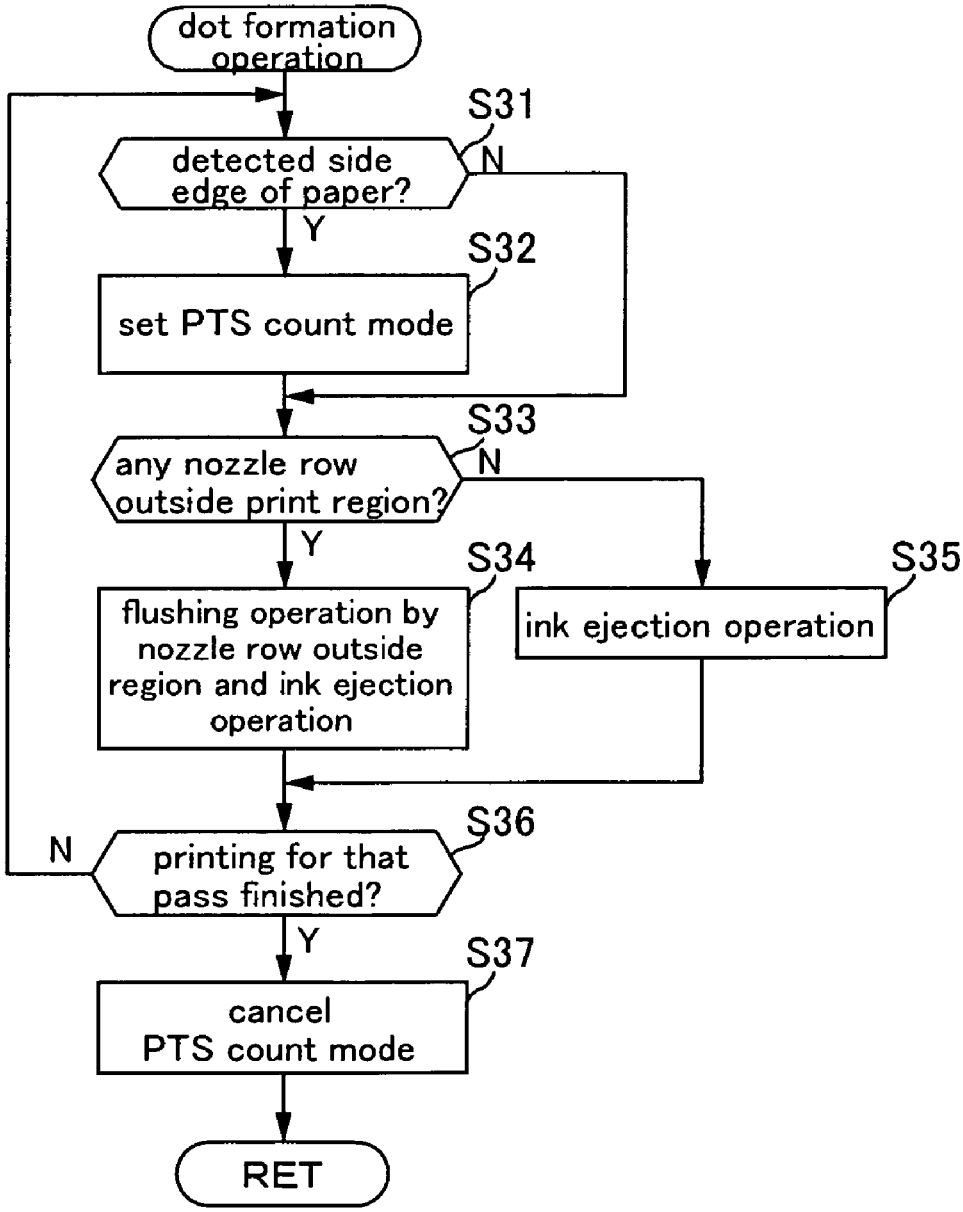
FIG. 14 is a flowchart for describing a dot formation operation.
Figure 15A:
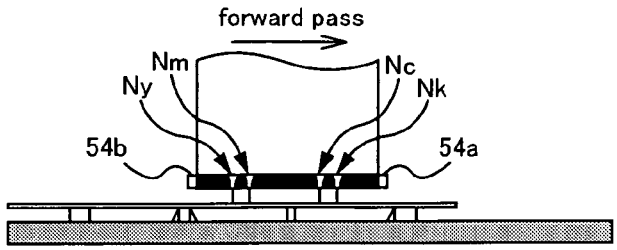
FIG. 15A is a diagram for describing a state in which the head is moving in the forward-pass direction and in which all of the nozzles are located above the paper.
Figure 15B:
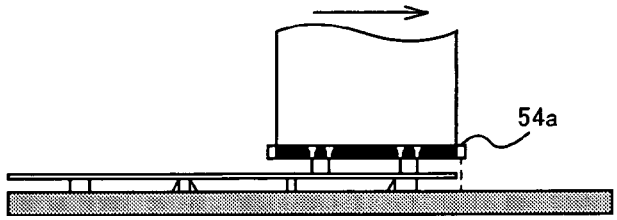
FIG. 15B is a diagram for describing a state in which the first paper width detector detects a side edge of the paper.
Figure 15C:
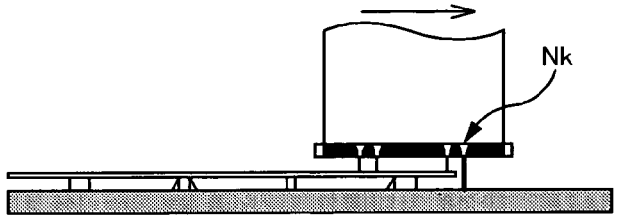
FIG. 15C is a diagram for describing a state in which a first nozzle row is performing the flushing operation while the other nozzle rows are performing the ink ejection operation for printing.
Figure 15D:
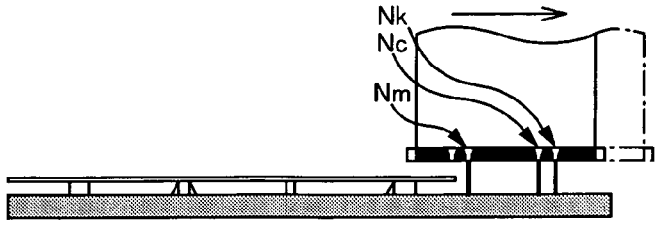
FIG. 15D is a diagram for describing a state in which the first nozzle row, the second nozzle row, and the third nozzle row are performing the flushing operation.
Figure 15E:
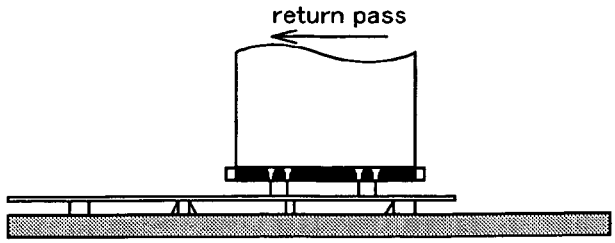
FIG. 15E is a diagram for describing a state in which the head is moving in the return-pass direction and in which all of the nozzle rows are performing the ink ejection operation for printing.

Below, the flushing operation will be described. It should be noted that the flushing operation is performed in the dot formation operation (S30). Therefore, the flushing operation will be described in the course of the dot formation operation. FIG. 14 is a flowchart for describing the dot formation operation. FIGS. 15A through 15E are conceptual diagrams for describing the relationship between the movement of the head 41 and the ejected ink. More specifically, FIG. 15A is a diagram for describing a state in which the head 41 is moving in the forward-pass direction and in which all of the nozzles Nz are located above the paper S; FIG. 15B is a diagram for describing a state in which the first paper width detector 54*a* detects a side edge of the paper S; FIG. 15C is a diagram for describing a state in which the first nozzle row Nk is performing the flushing operation while the other nozzle rows Nc to Ny are performing the ink ejection operation for printing; FIG. 15D is a diagram for describing a state in which the first nozzle row Nk, the second nozzle row Nc, and the third nozzle row Nm are performing the flushing operation; and FIG. 15E is a diagram for describing a state in which the head 41 is moving in the return-pass direction and in which all of the nozzle rows Nk to Ny are performing the ink ejection operation for printing.

In the dot formation operation (S30), the printer-side controller 60 determines whether or not the paper width detector 54 has detected a side edge of the paper S (S31). More specifically, the printer-side controller 60 makes this determination based on a detection signal from the paper width detector 54 provided on the front side, in the movement direction, of the head 41. That is, the side edge of the paper S is detected based on the detection signal from the first paper width detector 54*a* during the forward-pass movement of the head 41, and the side edge of the paper S is detected based on the detection signal from the second paper width detector 54*b* during the return-pass movement of the head 41. This is done to make the controller recognize that the nozzles Nz are approaching the side edge of the paper S before the nozzles Nz move outside the paper. In this way, it is possible perform the flushing operation immediately after the nozzles Nz move beyond the side edge of the paper S as described below, even with a configuration in which the paper width detectors 54 are provided on the side surfaces of the head case 42, i.e., a configuration in which the paper width detectors 54 and the nozzles Nz are arranged shifted from each other in the movement direction of the nozzles Nz.

In the determination of step S31, if the side edge of the paper S is detected, then the printer-side controller 60 sets the PTS count mode (S32). The PTS count mode is an operation mode for performing the ink ejection operation (S34 and S35) while counting the PTS signals (pulse signals) output from the linear encoder 51. In this mode, a PTS counter is counted up every time the PTS signal is input. The PTS counter is, for example, provide in the memory 63 of the printer-side controller 60. By referencing the PTS counter, the printer-side controller 60 can get hold of the positional relationship between the nozzle rows and the side edge of the paper S. This can be achieved because the distance, in the head movement direction, between the paper width detector 54 and each of the nozzle rows and also the distance for which the head 41 (the nozzles Nz) moves every time a PTS signal is input, are known.

After setting the PTS count mode in step S32, or when the side edge of the paper S is not detected in step S31, the printer-side controller 60 determines whether or not there is a nozzle row outside the print region (S33). In other words, it determines whether or not there is a nozzle row that has moved beyond the side edge of the paper S. The determination on whether or not there is a nozzle row is made based on the count value of the PTS counter. That is, it is possible to set, in advance, the number of counts necessary for each nozzle row to move beyond the side edge of the paper S after the paper width detector 54 detects the side edge of the paper S. By storing the number of counts necessary in the memory 63, the printer-side controller 60 can determine whether or not a nozzle row has moved beyond the side edge of the paper S based on the count value of the PTS counter.

In the determination of step S33, if it is determined that there is a nozzle row that is outside the print region, then the printer-side controller 60 makes the nozzle row outside the print region perform the flushing operation and makes the nozzle rows positioned within the print region perform the ink ejection operation based on the pixel data SI (S34). Describing this more specifically, as for the nozzle row outside the print region, the printer-side controller 60 changes the flushing control signal FL corresponding to that nozzle row from the H level (data "1") to the L level (data "0"). In this way, the drive pulse PS7 for the flushing operation is applied to the piezo elements 417 corresponding to the nozzle row outside the print region, irrespective of the contents of the pixel data SI. In this way, the flushing operation is performed. Since the flushing operation is performed using the drive pulse PS7 included in the second drive signal COM_B, it is not necessary to carry out such complicated operations as changing the drive signal COM to be generated, and thus the control can be simplified. Further, as for the other nozzle rows, the ink ejection operation is performed during the same period using the same drive signals COM (the first drive signal COM_A and the second drive signal COM_B).

It should be noted that it is preferable to synchronize the timing for changing the flushing control signal FL with the timing of the latch pulse. This is because, if the flushing control signal FL is changed while the other drive pulses PS1 through PS6 are being applied to the piezo elements 417, such problems as a sudden change in the potential of the piezo elements 417 imposing an excessive load on the piezo elements 417, may arise. By synchronizing the timing for changing the flushing control signal FL with the timing of the latch pulse, a smooth control that is less likely to impose a load on the piezo elements 417 can be achieved.

On the other hand, if it is determined that there is no nozzle row outside the print region in the determination of step S33, then the printer-side controller 60 makes all of the nozzle rows perform the ink ejection operation based on the pixel data SI (S35). That is, the controller makes them perform normal operation.

Next, the printer-side controller 60 determines whether or not printing for that pass has finished (S36). Herein, "pass" means an operation of moving the head 41 (the carriage CR) once toward one side in the head movement direction to form dots. Giving a specific example, a single pass corresponds to an operation from when the head 41 starts moving until it stops when the head is moved in the forward-pass direction. When the head 41 is moved back and forth, the number of passes will be two. Accordingly, in step S36, it is determined whether or not the carriage CR has been stopped. If a pass has finished, then the PTS count mode is cancelled (S37), and the carry operation is performed (S40; see FIG. 13). On the other hand, if a pass has not finished, then the procedure returns to step S31 and the above-described processing is repeated.

Next, a specific example of the flushing operation is described. First, as shown in FIG. 15A, the ink ejection operation based on the pixel data SI is performed (S35) in the period up to when the side edge of the paper S is detected. That is, the head 41 moves in the forward-pass direction and the nozzles Nz in each nozzle row eject ink of an amount according to the pixel data SI. Then, as shown in FIG. 15B, when the first paper width detector 54*a* on the front side in the moving direction detects the side edge of the paper S (S31), the printer-side controller 60 sets the PTS count mode (S32). In this way, the printer-side controller 60 increments the PTS counter every time the PTS signal is input.

Then, as shown in FIG. 15C, when the first nozzle row Nk moves beyond the side edge of the paper S, the printer-side controller 60 recognizes that the first nozzle row Nk has moved beyond the side edge of the paper S based on the count value of the PTS counter (S33). Then, the controller makes the first nozzle row Nk perform the flushing operation using the drive pulse PS7, and makes the second nozzle row Nc through the fourth nozzle row Ny perform the ink ejection operation based on the pixel data SI (S34). At this time, the ink ejected from the nozzles Nz of the first nozzle row Nk is absorbed by the ink absorbing member 241 provided on the platen 24. As the head 41 moves further in the forward-pass direction, the flushing operation is performed by the first nozzle row Nk through the third nozzle row Nm that have moved beyond the side edge of the paper S and the ink ejection operation is performed based on the pixel data SI by the fourth nozzle row Ny that has not yet moved beyond the side edge of the paper S, as shown in FIG. 15D (S34). When the head 41 moves to the position indicated by the alternate long-and-short dashed line, that pass is finished (S36). Accordingly, the PTS count mode is cancelled (S37), and the carry operation of the paper S is performed (S40).

After the paper S is carried, the head 41 moves in the return-pass direction as shown in FIG. 15E, and the ink ejection operation based on the pixel data SI is performed (S35). After this, the above-described operations are repeated until printing is finished (S70).

As described above, in the present embodiment, ejection of ink based on the pixel data SI and the flushing operation based on the drive pulse PS7 (the flushing drive pulse) are controlled nozzle row by nozzle row, and therefore, improvement in efficiency in processing is achieved also in this sense.

Second Embodiment

In the first embodiment described above, the drive signal generation circuit 70 simultaneously generates the first drive signal including the first drive pulse PS1 through fourth drive pulse PS4, which serve as the first ejection pulses, and the second drive signal including the fifth drive pulse PS5, which serves as the other first ejection pulse, and the seventh drive pulse PS7, which serves as the second ejection pulse. When the nozzles Nz are located above the paper S, the printer-side controller 60 applies the first drive pulse PS1 through fourth drive pulse PS4 and/or the fifth drive pulse PS5 to the piezo elements 417, and when the nozzles Nz are located outside the paper S, the controller applies the seventh drive pulse PS7 for causing the flushing operation to the piezo elements 417.

With this configuration, the flushing operation is achieved only by the seventh drive pulse PS7 included in the second drive signal COM_B. Therefore, there are cases in which it is difficult to shorten the interval at which the ink is ejected during flushing. The second embodiment has been achieved in view of such circumstances, and has an object of shortening the interval at which the ink is ejected during the flushing operation.

Figure 16:
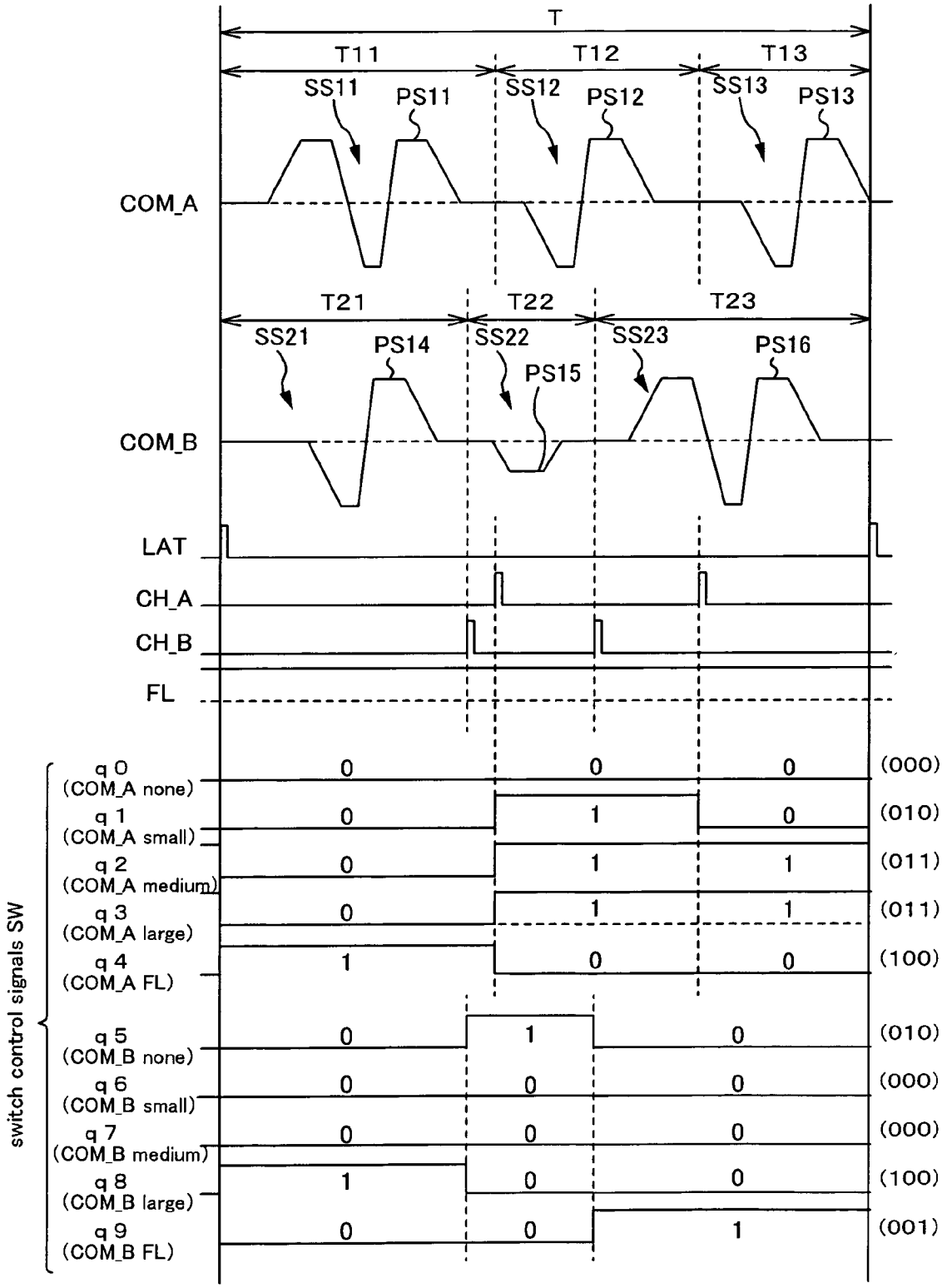
FIG. 16 is a diagram for describing a second embodiment, illustrating a first drive signal, a second drive signal, and necessary control signals.
Figure 17:
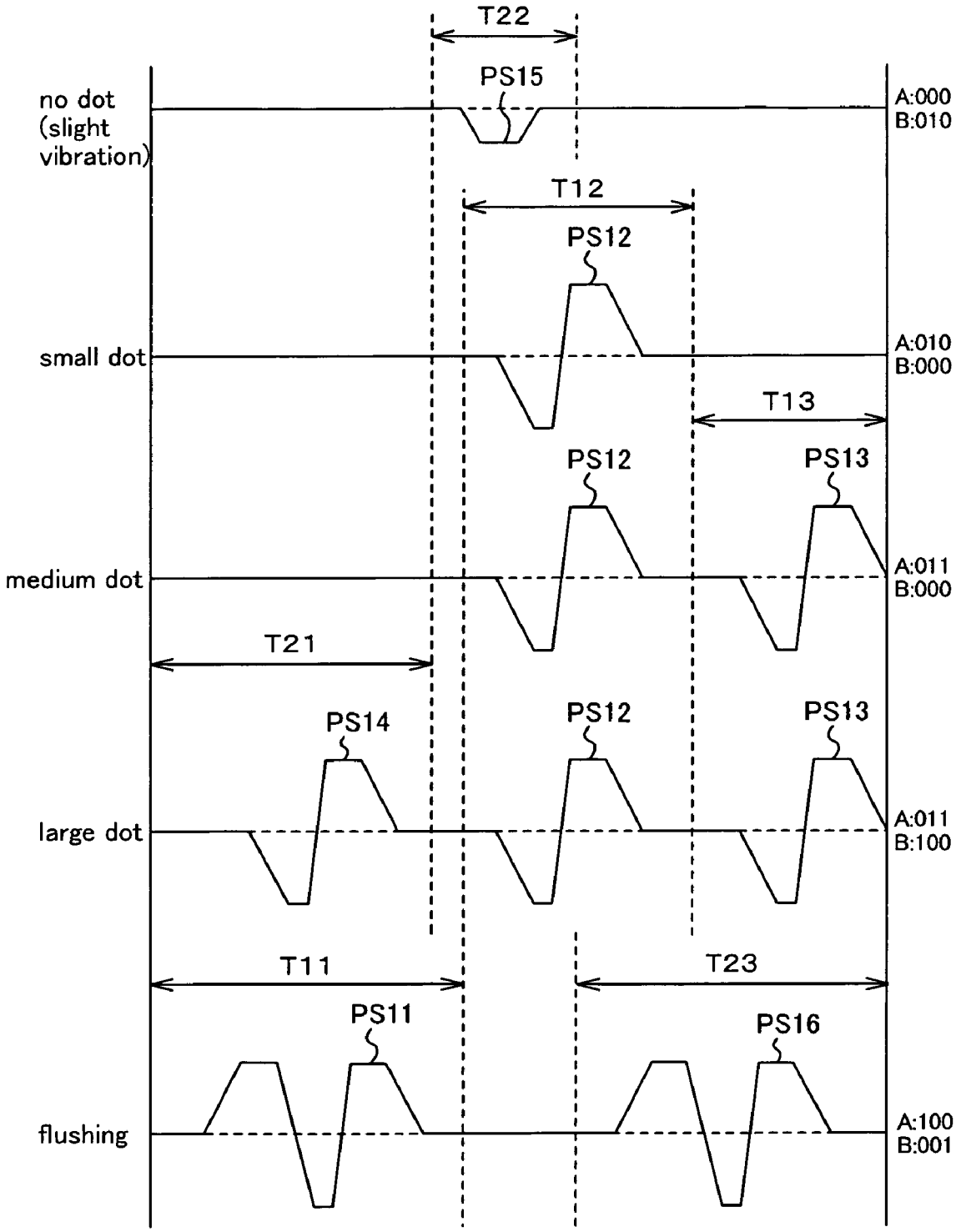
FIG. 17 is a diagram for describing waveform sections applied to a piezo element in the second embodiment when no dot is to be formed, when a small dot is to be formed, when a medium dot is to be formed, when a large dot is to be formed, and during the flushing operation.

The second embodiment is described below. FIG. 16 is a diagram for describing the second embodiment, illustrating a first drive signal COM_A, a second drive signal COM_B, and necessary control signals. FIG. 17 is a diagram for describing waveform sections applied to a piezo element 417 in the second embodiment when no dot is to be formed, when a small dot is to be formed, when a medium dot is to be formed, when a large dot is to be formed, and during the flushing operation.

The second embodiment is characterized in the first drive signal COM_A and the second drive signal COM_B, which are generated by the drive signal generation circuit 70, and how the drive pulses PS11 through PS16 included in the drive signals COM_A and COM_B are selected. The hardware configuration is the same as that of the first embodiment described above. Accordingly, only the drive signals COM_A and COM_B and the selection of the drive pulses PS11 through PS16 will be described here, and description on the hardware configuration is omitted.

<Overview of Second Embodiment>

A first feature of the second embodiment is that the drive pulses used for the flushing operation are included in both the first drive signal COM_A and the second drive signal COM_B. More specifically, the first drive signal COM_A includes a first drive signal PS11 (corresponding to a "second ejection pulse") as a drive pulse used for the flushing operation, and the second drive signal COM_B includes a sixth drive signal PS16 (corresponding to an "other second ejection pulse") as a drive pulse used for the flushing operation.

A second feature is that, in the flushing operation, the drive pulses are selected respectively from the first drive signal COM_A and the second drive signal COM_B and applied to the piezo elements 417. That is, in the flushing operation, the printer-side controller 70 applies the first drive signal PS11 included in the first drive signal COM_A and the sixth drive signal PS16 included in the second drive signal COM_B to the piezo elements 417.

With these features, according to the second embodiment, a process for changing the drive signals to be generated becomes unnecessary and thickened ink can be ejected with a simple control. Further, since the first drive signal PS11 and the sixth drive signal PS16 are used in causing ejection of the thickened ink, it is possible to shorten the interval at which the thickened ink is ejected, even in a limited repeating cycle T. As a result, it is possible to reliably discharge the thickened ink. This is described in detail below.

<Regarding the Generated Drive Signals>

First, the drive signals COM generated by the drive signal generation circuit 70 are described. In this embodiment also, the drive signal generation circuit 70 generates the first drive signal COM_A and the second drive signal COM_B simultaneously at least within a certain period.

The first drive signal COM_A has a first waveform section SS11 that is generated during a period T11 of a repeating cycle T, a second waveform section SS12 that is generated in a period T12, and a third waveform section SS13 that is generated in aperiod T13. Here, the first waveform section SS11 has a drive pulse PS11. Similarly, the second waveform section SS12 has a drive pulse PS12, and the third waveform section SS13 has a drive pulse PS13. The drive pulse PS11 is a flushing drive pulse for performing the flushing operation. The drive pulse PS11 corresponds to a "second ejection pulse" for causing ejection of ink that has thickened in viscosity. The drive pulse PS12 is applied to a piezo element 417 when a small dot, medium dot, or a large dot is to be formed. Further, the drive pulse PS13 is applied to a piezo element 417 when a large dot is to be formed. The drive pulse PS12 and the drive pulse PS13 are used for causing ejection of the ink toward the paper S, which serves as the targeted object, and thus correspond to a "first ejection pulse". It should be noted that in the present embodiment, the drive pulse PS11 has the same waveform as that of the seventh drive pulse PS7 in the first embodiment. Further, the drive pulse PS12 and the drive pulse PS13 have the same waveform as that of the first drive pulse PS1 in the first embodiment.

The second drive signal COM_B has a first waveform section SS21 that is generated in a period T21, a second waveform section SS22 that is generated in a period T22, and a third waveform section SS23 that is generated in a period T23. The second drive signal COM_B has a drive pulse PS14 in the first waveform section SS21, has a drive pulse PS15 in the second waveform section SS22, and a drive pulse PS16 in the third waveform section SS23. The drive pulse PS14 is applied to a piezo element 417 when a medium dot is to be formed. The drive pulse PS14 corresponds to an "other first ejection pulse". In the present embodiment, the drive pulse PS14 has the same waveform as that of, for example, the drive pulse PS12. The drive pulse PS15 is applied to a piezo element 417 when no dot is to be formed. The drive pulse PS15 is a micro-vibration drive pulse for slightly vibrating the meniscus. The drive pulse PS16 is a flushing drive pulse and is applied to a piezo element 417 when the thickened ink is to be ejected to an area outside the paper. The drive pulse PS16 corresponds to an "other second ejection pulse". In the present embodiment, the drive pulse PS16 has the same waveform as that of the drive pulse PS11.

In the second embodiment, the drive signal generation circuit 70 generates the drive pulse PS14, which serves as the other first ejection pulse, in a period in which the drive pulse PS11, which serves as the second ejection pulse, is being generated. In this way, it is possible to efficiently generate these drive pulses PS11 and PS14, even within a limited period. Similarly, the drive signal generation circuit 70 generates the drive pulse PS16, which serves as the other second ejection pulse, in a period in which the drive pulses PS12 and PS13, which serve as the first ejection pulses, are being generated. In this way, it is possible to efficiently generate these drive pulses PS12, PS13, and PS16, even within a limited period.

<Regarding Ink Ejection Control>

Ink ejection control in the printer 1 is described next with reference to FIG. 17.

First, a case in which no dot is formed (i.e., when the pixel data SI is data "00" and the flushing control signal FL is data "1") will be described. In this case, the decoder 83 selects the first selection data q0 and the second selection data q5, and outputs these as the first switch control signal SW_A and the second switch control signal SW_B. In the present embodiment, the first switch control signal SW_A is data "000" and the second switch control signal SW_B is data "010". These data are output on a time series. As a result, as shown on the upper stage in FIG. 17, the second drive signal COM_B is applied to the piezo element 417 in period T22 and the meniscus is slightly vibrated by the drive pulse PS15.

Next, a case in which a small dot is formed (i.e., when the pixel data SI is data "01" and the flushing control signal FL is data "1") will be described. In this case, the decoder 83 selects the first selection data q1 and the second selection data q6, and outputs these as the first switch control signal SW_A and the second switch control signal SW_B. In the present embodiment, the first switch control signal SW_A is data "010" and the second switch control signal SW_B is data "000". These data are output on a time series. As a result, as shown on the second stage from the top in FIG. 17, the first drive signal COM_A is applied to the piezo element 417 in period T12 and ink of an amount corresponding to a small dot is ejected from the nozzle Nz by the drive pulse PS12.

Next, a case in which a medium dot is formed (i.e., when the pixel data SI is data "10" and the flushing control signal FL is data "1") will be described. In this case, the decoder 83 selects the first selection data q2 and the second selection data q7, and outputs these as the first switch control signal SW_A and the second switch control signal SW_B. In the present embodiment, the first switch control signal SW A is data "011" and the second switch control signal SW_B is data "000". These data are output on a time series. As a result, as shown on the middle stage in FIG. 17, the first drive signal COM_A is applied to the piezo element 417 during the periods T12 and T13 and thus ink of an amount corresponding to a medium dot is ejected from the nozzle Nz by the drive pulses PS12 and PS13.

Next, a case in which a large dot is formed (i.e., when the pixel data SI is data "11" and the flushing control signal FL is data "1") will be described. In this case, the decoder 83 selects the first selection data q3 and the second selection data q8, and outputs these as the first switch control signal SW_A and the second switch control signal SW_B. In the present embodiment, the first switch control signal SW_A is data "011" and the second switch control signal SW B is data "100". These data are output on a time series. As a result, as shown on the second stage from the bottom in FIG. 17, the second drive signal COM_B is applied to the piezo element 417 in period T21 and the first drive signal COM_A is applied to the piezo element 417 during the periods T12 and T13. Thus, ink of an amount corresponding to a large dot is ejected from the nozzle Nz by the drive pulses PS14, PS12, and PS13.

Finally, a case in which the flushing operation is performed (i.e., when the flushing control signal FL is data "0") will be described. In this case, the decoder 83 selects the first selection data q4 and the second selection data q9 irrespective of the contents of the pixel data SI, and outputs these as the first switch control signal SW_A and the second switch control signal SW_B. In the present embodiment, the first switch control signal SW_A is data "100" and the second switch control signal SW_B is data "001". These data are output on a time series. As a result, as shown on the bottom stage in FIG. 17, the first drive signal COM_A is applied to the piezo element 417 in period T1 and the second drive signal COM_B is applied to the piezo element 417 in period T23. Thus, ink of a state (amount and velocity) suitable for the flushing operation is ejected from the nozzle Nz by the drive pulses PS11 and PS16.

At this time, the drive pulses PS11 and PS16 for the flushing operation are applied to the piezo element 417 in each repeating cycle T. Therefore, it is possible to shorten the interval at which the thickened ink is ejected, even in a limited repeating cycle T. As a result, the thickened ink can be ejected reliably.

<Regarding Printing Operation>

The printing operation of the second embodiment is the same as that of the first embodiment described above, and is carried out according to the flowcharts shown in FIG. 13 and FIG. 14. Describing this simply, the ink ejection operation based on the pixel data SI is performed in the period up until the side edge of the paper S is detected (see FIG. 15A). That is, the head 41 moves in a certain direction, and ink of an amount according to the pixel data SI is ejected from the nozzles Nz in each nozzle row. At this time, the amount of ink is changed by selectively applying, to the piezo elements 417, the drive pulses PS12 and PS13 (corresponding to the first ejection pulse) included in the first drive signal COM_A and the drive pulse PS14 (corresponding to the other first ejection pulse) included in the second drive signal. Therefore, it is possible to increase the degree of freedom of the ink to be ejected, even in a limited period.

When the paper width detector (the first paper width detector 54*a* or the second paper width detector 54b) on the front side in the moving direction detects the side edge of the paper S, the PTS count mode is set. Then, every time a nozzle row (the first nozzle row Nk through fourth nozzle row Ny) moves beyond the side edge of the paper S, the flushing operation according to the drive pulses PS11 and PS16 is performed by that nozzle row that has moved beyond the side edge. In this way, it is possible to simultaneously perform printing of an image and discharging of thickened ink. Here, since two drive pulses PS11 and PS16 are used with respect to a single repeating cycle T, it is possible to shorten the interval at which the ink is ejected, even in a limited time period, and thus, it is possible to eject the thickened ink reliably.

Third Embodiment

In the first and second embodiments described above, the drive pulse PS7 (first embodiment) and the drive pulses PS11 and PS16 (second embodiment) are generated as the drive pulses for the flushing operation. In these examples, depending on the combination of the drive pulses (first ejection pulses) included in the drive signals COM_A and COM_B, there are cases in which a period for inserting the pulse for flushing cannot be provided. The third embodiment has been achieved in view of such circumstances, and herein, the drive pulse for the flushing operation is divided into one portion and another portion, and the one portion is included in the first drive signal COM_A and the other portion is included in the second drive signal COM_B. When performing the flushing operation, the one portion and the other portion of the drive pulse are applied to the piezo elements 417.

Figure 18:
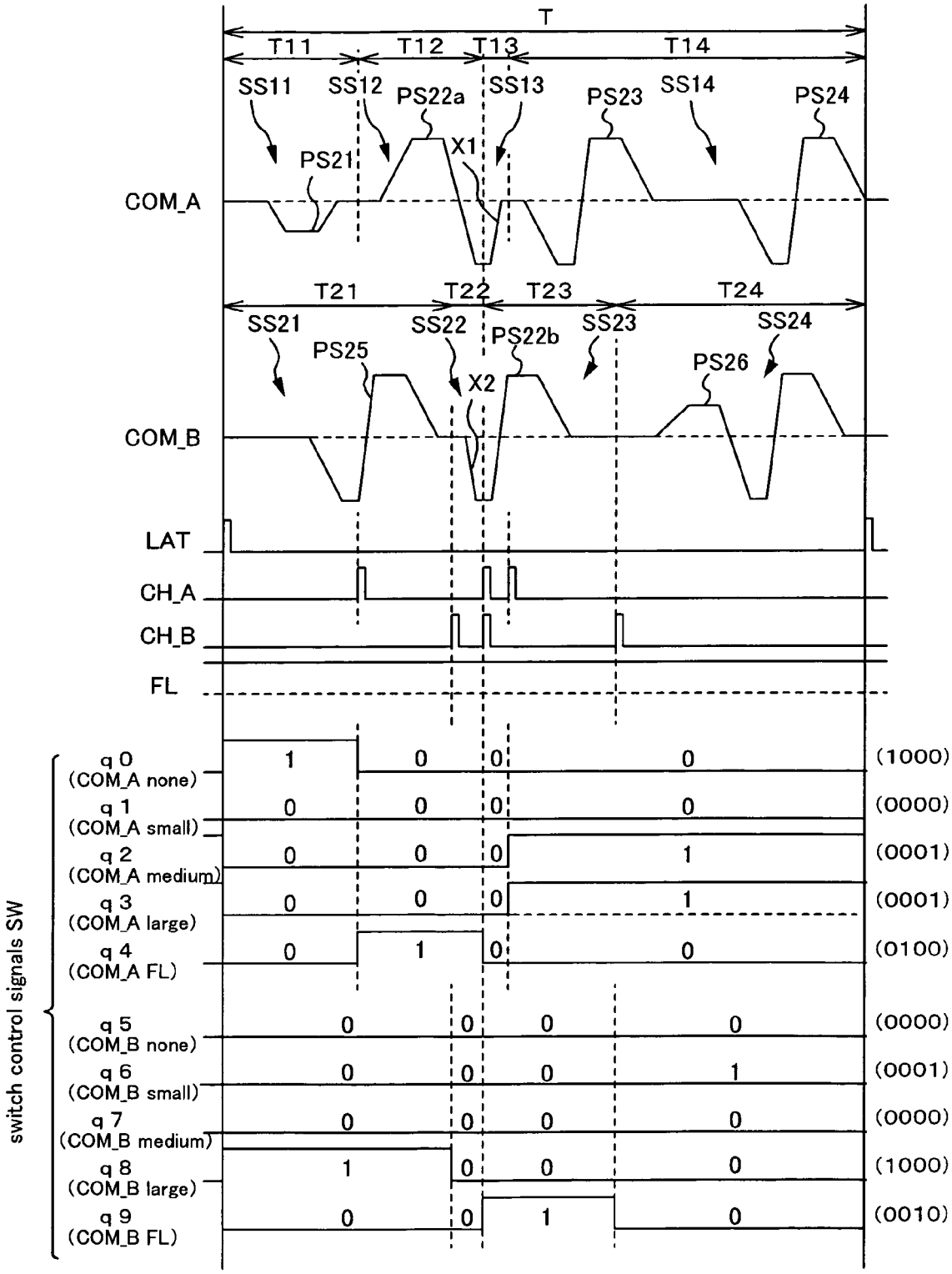
FIG. 18 is a diagram for describing a third embodiment, illustrating a first drive signal, a second drive signal, and necessary control signals.
Figure 19:
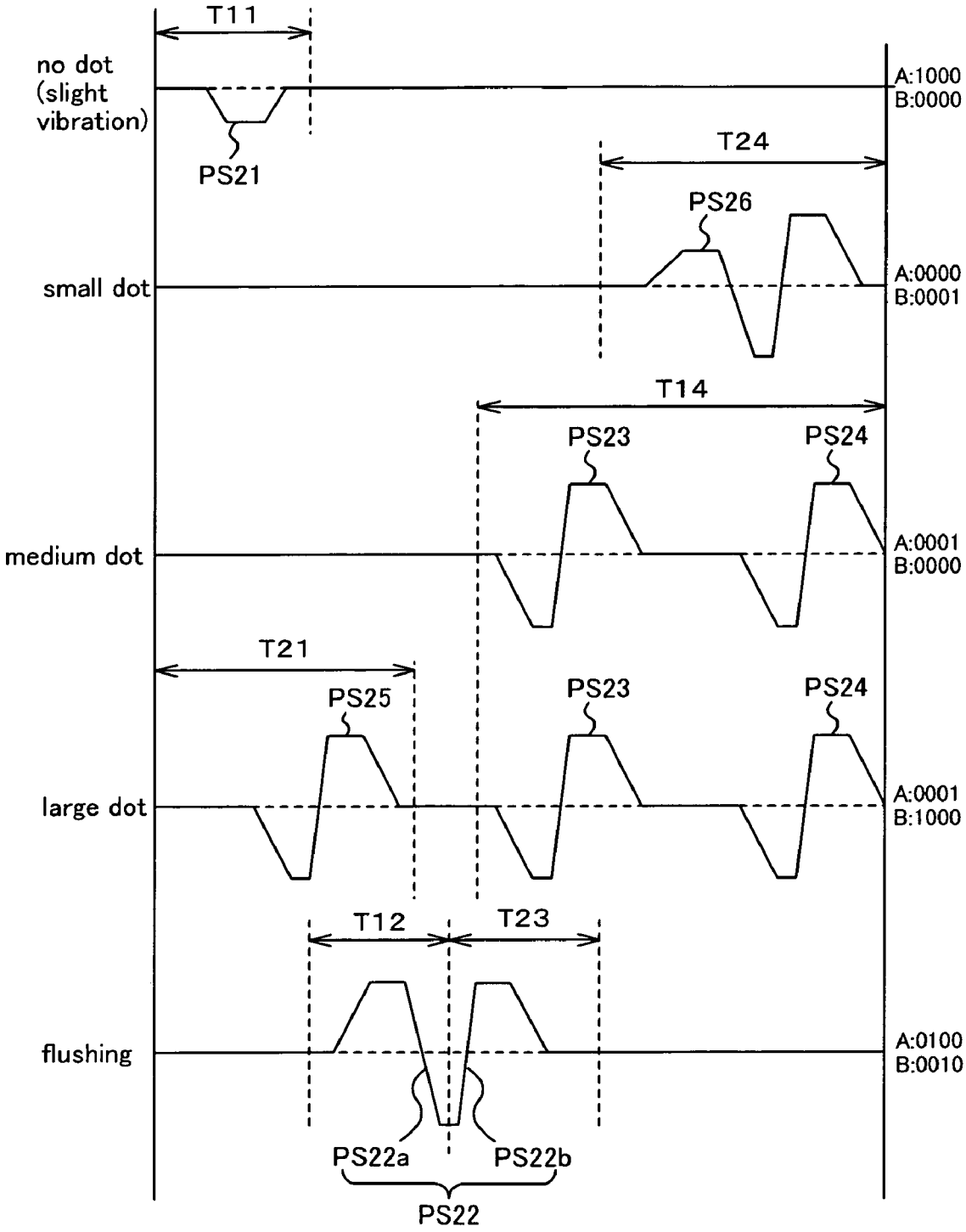
FIG. 19 is a diagram for describing waveform sections applied to a piezo element in the third embodiment when no dot is to be formed, when a small dot is to be formed, when a medium dot is to be formed, when a large dot is to be formed, and during the flushing operation.

The third embodiment is described below. FIG. 18 is a diagram for describing the third embodiment, illustrating a first drive signal COM_A, a second drive signal COM_B, and necessary control signals. FIG. 19 is a diagram for describing waveform sections applied to a piezo element 417 in the third embodiment when no dot is to be formed, when a small dot is to be formed, when a medium dot is to be formed, when a large dot is to be formed, and during the flushing operation.

As in the second embodiment, the third embodiment is characterized in the first drive signal COM_A and the second drive signal COM_B, which are generated by the drive signal generation circuit 70, and how the drive pulses PS21 through PS26 included in the drive signals COM_A and COM_B are selected. The hardware configuration is the same as that of the first embodiment described above. Accordingly, only the drive signals COM_A and COM_B and the selection of the drive pulses PS21 through PS26 will be described here, and description on the hardware configuration is omitted.

<Overview of Third Embodiment>

A first feature of the third embodiment is that the drive pulse PS22 used for the flushing operation is divided into one portion PS22*a* and another portion PS22*b*, the portion PS22*a* (corresponding to a "one portion of the second ejection pulse") is included in the first drive signal COM_A, and the other portion PS22*b* (corresponding to an "other portion of the second ejection pulse") is included in the second drive signal COM_B.

A second feature is that, in the flushing operation, the portion PS22*a* of the drive pulse PS22 included in the first drive signal COM_A and the other portion PS22*b* of the drive pulse PS22 included in the second drive signal COM_B are applied to the piezo elements 417.

With these features, according to the third embodiment, a process for changing the drive signals to be generated becomes unnecessary and thickened ink can be ejected with a simple control. Further, since the portion PS22*a* of the drive pulse PS22 included in the first drive signal COM_A and the other portion PS22*b* of the drive pulse PS22 included in the second drive signal COM_B are used in causing ejection of the thickened ink, it is possible to efficiently include various drive pulses, even in a limited repeating cycle T. This is described in detail below.

p21 Regarding the Generated Drive Signals>

First, the drive signals COM generated by the drive signal generation circuit 70 are described. In this embodiment also, the drive signal generation circuit 70 generates the first drive signal COM_A and the second drive signal COM_B simultaneously at least within a certain period.

The first drive signal COM_A has a first waveform section SS11 that is generated during a period T11 of a repeating cycle T, a second waveform section SS12 that is generated in a period T12, a third waveform section SS13 that is generated in a period T13, and a fourth waveform section SS14 that is generated in a period T14. Here, the first waveform section SS11 has a drive pulse PS21, and the second waveform section SS12 has a portion PS22*a* of a drive pulse PS22. The third waveform section SS13 has a waveform X1 for connection that is not applied to the piezo elements 417, and thus does not include a drive pulse. The connection waveform X1 is not applied to the piezo elements 417, and therefore, its slope in potential can be made steep. In this way, it is possible to generate, at an extremely short interval, waveform sections whose ending potential and starting potential are different. The fourth waveform section SS14 has a drive pulse PS23 and a drive pulse PS24.

The drive pulse PS21 is a micro-vibration drive pulse for slightly vibrating the meniscus. The drive pulse PS22 is a flushing drive pulse for performing the flushing operation. The drive pulse PS22 corresponds to a "second ejection pulse" for causing ejection of ink that has thickened in viscosity. The drive pulse PS23 and the drive pulse PS24 are applied to a piezo element 417 when a medium dot or a large dot is to be formed. The drive pulse PS23 and the drive pulse PS24 correspond to a "first ejection pulse" for causing ejection of the ink toward the paper S, which serves as the targeted object. It should be noted that in the present embodiment, the drive pulse PS22 has the same waveform as that of the seventh drive pulse PS7 in the first embodiment. Further, the drive pulse PS23 and the drive pulse PS24 have the same waveform as that of the first drive pulse PS1 in the first embodiment.

The second drive signal COM_B has a first waveform section SS21 that is generated in a period T21, a second waveform section SS22 that is generated in a period T22, a third waveform section SS23 that is generated in a period T23, and a fourth waveform section SS24 that is generated in a period T24. Here, the first waveform section SS21 has a drive pulse PS25. The second waveform section SS22 has a waveform X2 for connection that is not applied to the piezo elements 417, and thus does not include a drive pulse. Alike the connection waveform X1, the connection waveform X2 is not applied to the piezo elements 417, and therefore, its slope in potential can be made steep. In this way, it is possible to generate, at an extremely short interval, waveform sections whose ending potential and starting potential are different. The third waveform section SS23 has another portion PS22*b* of the drive pulse PS22. The fourth waveform section SS24 has a drive pulse PS26.

The drive pulse PS25 is applied to a piezo element 417 when a large dot is to be formed, and corresponds to an "other first ejection pulse". The drive pulse PS26 is applied to a piezo element 417 when a small dot is to be formed, and also corresponds to an "other first ejection pulse".

In the third embodiment, the drive signal generation circuit 70 generates the drive pulse PS25 (corresponding to the other first ejection pulse) in a period in which the portion PS22*a* of the drive pulse PS22 (corresponding to the one portion of the second ejection pulse) is being generated. In this way, it is possible to efficiently generate the portion PS22*a* of the drive pulse PS22 and the drive pulse PS25, even within a limited period.

Similarly, the drive signal generation circuit 70 generates the other portion PS22*b* of the drive pulse PS22 (corresponding to the other portion of the second ejection pulse) in a period in which the drive pulse PS23 (corresponding to the first ejection pulse) is being generated. In this way, it is possible to efficiently generate the drive pulse PS23 and the other portion PS22*b* of the drive pulse PS22, even within a limited period.

<Regarding Ink Ejection Control>

Ink ejection control in the printer 1 is described next with reference to FIG. 19.

First, a case in which no dot is formed (i.e., when the pixel data SI is data "00" and the flushing control signal FL is data "1") will be described. In this case, the decoder 83 selects the first selection data q0 and the second selection data q5, and outputs these as the first switch control signal SW_A and the second switch control signal SW_B. In the present embodiment, the first switch control signal SW_A is data "1000" and the second switch control signal SW_B is data "0000". These data are output on a time series. As a result, as shown on the upper stage in FIG. 19, the first drive signal COM_A is applied to the piezo element 417 in period T11 and the meniscus is slightly vibrated by the drive pulse PS21.

Next, a case in which a small dot is formed (i.e., when the pixel data SI is data "01" and the flushing control signal FL is data "1") will be described. In this case, the decoder 83 selects the first selection data q1 and the second selection data q6, and outputs these as the first switch control signal SW_A and the second switch control signal SW_B. In the present embodiment, the first switch control signal SW_A is data "0000" and the second switch control signal SW B is data "0001". These data are output on a time series. As a result, as shown on the second stage from the top in FIG. 19, the second drive signal COM_B is applied to the piezo element 417 in period T24 and ink of an amount corresponding to a small dot is ejected from the nozzle Nz by the drive pulse PS26.

Next, a case in which a medium dot is formed (i.e., when the pixel data SI is data "10" and the flushing control signal FL is data "1") will be described. In this case, the decoder 83 selects the first selection data q2 and the second selection data q7, and outputs these as the first switch control signal SW_A and the second switch control signal SW_B. In the present embodiment, the first switch control signal SW_A is data "0001" and the second switch control signal SW_B is data "0000". These data are output on a time series. As a result, as shown on the middle stage in FIG. 19, the first drive signal COM_A is applied to the piezo element 417 in period T14 and thus ink of an amount corresponding to a medium dot is ejected from the nozzle Nz by the drive pulses PS23 and PS24.

Next, a case in which a large dot is formed (i.e., when the pixel data SI is data "11" and the flushing control signal FL is data "1") will be described. In this case, the decoder 83 selects the first selection data q3 and the second selection data q8, and outputs these as the first switch control signal SW_A and the second switch control signal SW_B. In the present embodiment, the first switch control signal SW_A is data "0001" and the second switch control signal SW_B is data "1000". These data are output on a time series. As a result, as shown on the second stage from the bottom in FIG. 19, the second drive signal COM_B is applied to the piezo element 417 in period T21 and the first drive signal COM_A is applied to the piezo element 417 in period T14. Thus, ink of an amount corresponding to a large dot is ejected from the nozzle Nz by the drive pulses PS25, PS23, and PS24.

Finally, a case in which the flushing operation is performed (i.e., when the flushing control signal FL is data "0") will be described. In this case, the decoder 83 selects the first selection data q4 and the second selection data q9 irrespective of the contents of the pixel data SI, and outputs these as the first switch control signal SW_A and the second switch control signal SW_B. In the present embodiment, the first switch control signal SW A is data "0100" and the second switch control signal SW_B is data "0010". These data are output on a time series. As a result, as shown on the bottom stage in FIG. 19, the first drive signal COM_A is applied to the piezo element 417 in period T12 and the second drive signal COM_B is applied to the piezo element 417 in period T23. Thus, ink of a state (amount and velocity) suitable for the flushing operation is ejected from the nozzle Nz by the portion 22*a* and the other portion PS22*b* of the drive pulse PS22 (that is, the drive pulse PS22).

As described above, in the third embodiment, the drive pulse PS22 for the flushing operation is divided and included respectively in the first drive signal COM_A and the second drive signal COM_B. Therefore, the period in which to generate the drive pulse PS22 can be distributed between the first drive signal COM_A and the second drive signal COM_B, and thus, it is possible to include various drive pulses even in a limited repeating cycle T.

<Regarding Printing Operation>

The printing operation of the third embodiment is also the same as that of the first embodiment described above, and is carried out according to the flowcharts shown in FIG. 13 and FIG. 14. Describing this simply, the ink ejection operation based on the pixel data SI is performed in the period up until the side edge of the paper S is detected (see FIG. 15A). That is, the head 41 moves in a certain direction, and ink of an amount according to the pixel data SI is ejected from the nozzles Nz in each nozzle row. At this time, the amount of ink is changed by selectively applying, to the piezo elements 417, the drive pulses PS23 and PS24 (corresponding to the first ejection pulse) included in the first drive signal COM_A and the drive pulse PS25 (corresponding to the other first ejection pulse) included in the second drive signal. Therefore, it is possible to increase the degree of freedom of the ink to be ejected, even in a limited period.

When the paper width detector (the first paper width detector 54*a* or the second paper width detector 54*b*) on the front side in the moving direction detects the side edge of the paper S, the PTS count mode is set. Then, every time a nozzle row (the first nozzle row Nk through fourth nozzle row Ny) moves beyond the side edge of the paper S, the flushing operation according to the drive pulse PS22 (the portion 22*a* and the other portion PS22*b* of the drive pulse PS22) is performed by that nozzle row that has moved beyond the side edge. In this way, it is possible to simultaneously perform printing of an image and discharging of thickened ink.

Other Embodiments

The foregoing embodiments primarily describe a printing system 100 that includes a printer 1, but they also include the disclosure of a method of applying drive signals COM and a liquid ejection system, etc. The foregoing embodiments are for the purpose of elucidating the present invention, and are not to be interpreted as limiting the present invention. The invention can of course be altered and improved without departing from the gist thereof, and includes equivalents. In particular, the embodiments mentioned below also fall within the scope of the invention.

<Regarding Drive Signals COM>

In the first embodiment described above, the drive pulse PS7 for the flushing operation is included in the second drive signal COM_B along with the drive pulse PS5 for a small dot and the drive pulse PS6 for the micro-vibration operation, but the configuration is not limited to the above. For example, only the drive pulse PS7 for flushing may be included in the second drive signal COM_B. Further, it is also possible to generate three or more drive signals COM simultaneously, and use one drive signal COM exclusively for the drive pulse PS7 for the flushing operation. These apply to the other embodiments as well.

<Regarding Selection of Drive Pulses>

In the foregoing embodiments, the flushing operation is controlled using the flushing control signal FL, but the configuration is not limited to the above. For example, a gradation value expressed in the pixel data SI may be assigned for the flushing operation. For example, the pixel data SI "00" may indicate no dot (non-ejection of ink), the pixel data SI "01" may indicate formation of a small dot, the pixel data SI "10" may indicate formation of a large dot, and the pixel data SI "11" may indicate execution of the flushing operation. In this case, the control may be performed using eight gradations by employing three bits for the pixel data SI, and one of those gradations may be assigned for the flushing operation. Further, instead of the flushing control signal FL, a signal (so-called N-charge signal NCHG) that is used when applying the drive signal COM to all of the piezo elements 417 at once may be employed.

<Regarding Nozzles Nz>

In the foregoing embodiments, the nozzles Nz are provided in the carrying direction to form a nozzle row, and a plurality of these nozzle rows are provided at different positions in the nozzle movement direction (corresponding to the "predetermined direction" and the carriage movement direction). However, the number of nozzles Nz and their arrangement are not limited to the above configuration. For example, the number of nozzle rows may be one, or five or more. Further, the above can be implemented likewise, even when liquid is to be ejected from a single nozzle Nz. That is, nozzle rows made up of a plurality of nozzles Nz do not have to be provided. However, by forming the nozzle row using a plurality of nozzles Nz, it is possible to eject the liquid efficiently. Further, by providing a plurality of these nozzle rows, it is possible to eject several types of liquid at the same time.

<Regarding Other Application Examples>

A printer 1 was described in the above embodiments, but this is not a limitation. For example, it is also possible to adopt the same technology as that of the foregoing embodiments to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods therefor and manufacturing methods thereof are also within the scope of application.

Further, as in the foregoing embodiments, by employing liquid ink for printing as the liquid and employing a medium (such as paper S) on which an image is to be printed as the targeted object, thickened ink can be ejected with a simple control as regards the liquid ink for printing that is easily affected by thickening in viscosity.

Further, in the foregoing embodiments, a printer 1 of a type in which the nozzles Nz move above the paper is exemplified. This, however, is not a limitation. For example, the above can be implemented even with cases where the nozzles Nz are fixed and the targeted object is moved.

What is claimed is:

1. A liquid ejection method comprising:

(a) simultaneously generating a first drive signal including a first ejection pulse for causing a liquid to be ejected to a targeted object, and a second drive signal including a second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse to the element, wherein a plurality of the nozzles are provided at different positions in a predetermined direction, and the nozzles are movable in the predetermined direction, wherein when at least one of the nozzles is located above the targeted object, the first ejection pulse is applied to the element corresponding to that nozzle, and wherein when at least one of the nozzles is located outside the targeted object, the second ejection pulse is applied to the element corresponding to that nozzle.

2. A liquid ejection method according to claim 1, wherein a plurality of the nozzles are provided at different positions in an other predetermined direction intersecting with the predetermined direction, to form a nozzle row;

wherein when the nozzle row is located above the targeted object, the first ejection pulse is applied to the elements respectively corresponding to the nozzles in that nozzle row; and wherein when the nozzle row is located outside the targeted object, the second ejection pulse is applied to the elements respectively corresponding to the nozzles in that nozzle row.

3. A liquid ejection method according to claim 1, further comprising determining whether or not at least one of the nozzles is located above the targeted object based on a detection result from a sensor that moves along with the nozzles and that detects whether or not the targeted object is present.

4. A liquid ejection method according to claim 1, wherein the second ejection pulse is generated in a period in which the first ejection pulse is being generated.

5. A liquid ejection method according to claim 1, wherein the liquid is a liquid ink for printing; and wherein the targeted object is a medium on which an image is to be printed.

6. A liquid ejection method comprising:

(a) simultaneously generating a first drive signal including a first ejection pulse for causing a liquid to be ejected to a targeted object, and a second drive signal including a second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse to the element;

wherein the second drive signal further includes another first ejection pulse for causing the liquid to be ejected to the targeted object, and the second drive signal is generated simultaneously with the first drive signal; and wherein when the nozzle is located above the targeted object, at least one of the first ejection pulse and the other first ejection pulse is applied to the element.

7. A liquid ejection method comprising:

(a) simultaneously generating a first drive signal including a first ejection pulse for causing a liquid to be ejected to a targeted object and a second ejection pulse for causing the liquid that has thickened in viscosity to be ejected outside the targeted object, and a second drive signal including an other second ejection pulse for causing the liquid that has thickened in viscosity to be ejected outside the targeted object;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the second ejection pulse and the other second ejection pulse to the element.

8. A liquid ejection method according to claim 7, wherein a plurality of the nozzles are provided at different positions in a predetermined direction, and the nozzles are movable in the predetermined direction;

wherein when at least one of the nozzles is located above the targeted object, the first ejection pulse is applied to the element corresponding to that nozzle; and wherein when at least one of the nozzles is located outside the targeted object, the second ejection pulse and the other second ejection pulse are applied to the element corresponding to that nozzle.

9. A liquid ejection method according to claim 8, wherein a plurality of the nozzles are provided at different positions in an other predetermined direction intersecting with the predetermined direction, to form a nozzle row;

wherein when the nozzle row is located above the targeted object, the first ejection pulse is applied to the elements respectively corresponding to the nozzles in that nozzle row; and wherein when the nozzle row is located outside the targeted object, the second ejection pulse and the other second ejection pulse are applied to the elements respectively corresponding to the nozzles in that nozzle row.

10. A liquid ejection method according to claim 7, wherein the other second ejection pulse is generated in a period in which the first ejection pulse is being generated.

11. A liquid ejection method according to claim 10, wherein the second drive signal flirt her includes an other first ejection pulse for causing the liquid to be ejected to the targeted object, and this second drive signal is generated simultaneously with the first drive signal; and wherein when the nozzle is located above the targeted object, at least one of the first ejection pulse and the other first ejection pulse is applied to the element.

12. A liquid ejection method according to claim 11, wherein the second ejection pulse is generated in a period in which the other first ejection pulse is being generated.

13. A liquid ejection method comprising:

(a) simultaneously generating a first drive signal including a first ejection pulse for causing a liquid to be ejected to a targeted object and one portion of a second ejection pulse for causing the liquid that has thickened in viscosity to be ejected outside the targeted object, and a second drive signal including an other portion of the second ejection pulse;

(b) when a nozzle that is caused to eject the liquid toward the targeted object is located above the targeted object, applying the first ejection pulse to an element that is provided corresponding to the nozzle and that performs an operation for causing the liquid to be ejected; and (c) when the nozzle is located outside the targeted object, applying the one portion and the other portion of the second ejection pulse to the element.

14. A liquid ejection method according to claim 13, wherein a plurality of the nozzles are provided at different positions in a predetermined direction, and the nozzles are movable in the predetermined direction;

wherein when at least one of the nozzles is located above the targeted object, the first ejection pulse is applied to the element corresponding to that nozzle; and wherein when at least one of the nozzles is located outside the targeted object, the one portion and the other portion of the second ejection pulse are applied to the element corresponding to that nozzle.

15. A liquid ejection method according to claim 14, wherein a plurality of the nozzles are provided at different positions in an other predetermined direction intersecting with the predetermined direction, to form a nozzle row;

wherein when the nozzle row is located above the targeted object, the first ejection pulse is applied to the elements respectively corresponding to the nozzles in that nozzle row; and wherein when the nozzle is located outside the targeted object, the one portion and the other portion of the second ejection pulse are applied to the elements respectively corresponding to the nozzles in that nozzle row.

16. A liquid ejection method according to claim 13, wherein the other portion of the second ejection pulse is generated in a period in which the first ejection pulse is being generated.

17. A liquid ejection method according to claim 13, wherein the second drive signal further includes an other first ejection pulse for causing the liquid to be ejected to the targeted object, and this second drive signal is generated simultaneously with the first drive signal;

wherein when the nozzle is located above the targeted object, at least one of the first ejection pulse and the other first ejection pulse is applied to the element; and wherein when the nozzle is located outside the targeted object, the one portion and the other portion of the second ejection pulse are applied to the element.

18. A liquid ejection method according to claim 17, wherein the one portion of the second ejection pulse is generated in a period in which the other first ejection pulse is being generated.

* * * * *